United States Patent [19]

Nakagawa et al.

[11] Patent Number: 5,008,168

[45] Date of Patent: Apr. 16, 1991

[54] PHOTOSENSITIVE MEMBER FOR ELECTROPHOTOGRAPHY

[75] Inventors: Masaru Nakagawa; Fumio Sumino, both of Yokohama; Masaaki Hiro, Kanagawa; Noboru Kashimura, Kawasaki; Shin Nagahara, Tokyo, all of Japan

[73] Assignee: Canon Kabushiki Kaisha, Tokyo, Japan

[21] Appl. No.: 338,844

[22] Filed: Apr. 17, 1989

[30] Foreign Application Priority Data

Apr. 18, 1988 [JP] Japan ..... 63-95851
Mar. 2, 1989 [JP] Japan ..... 1-51729

[51] Int. Cl.[5] ..... G03G 5/06

[52] U.S. Cl. ..... 430/56; 430/57; 430/70; 252/407; 252/400.2

[58] Field of Search ..... 430/56, 57, 70; 252/400.2, 407

[56] References Cited

U.S. PATENT DOCUMENTS 4,443,528 4/1984 Tamura et al. ..... 430/78 X

*Primary Examiner*—David Welsh

*Attorney, Agent, or Firm*—Fitzpatrick, Cella, Harper & Scinto

[57] ABSTRACT

A photosensitive member for electrophotography comprising: an electroconductive substrate and a photosensitive layer disposed thereon comprising an organic photoconductor is provided. the photosensitive layer contains at least, a compound represented by the following formula (I):

(I)

wherein $X_1$ denotes a t-butyl or t-amyl group, and $X_2$ denotes a hydrogen atom, an alkyl group having 1-10 carbon atoms or an alkenyl group having 2-10 carbon atoms; and a compound represented by the following formula (II):

(II)

wherein $X_3$ and $X_4$ respectively denote an alkyl group having 1-10 carbon atoms or an alkenyl group having 2-10 carbon atoms.

42 Claims, 1 Drawing Sheet

PHOTOSENSITIVE MEMBER FOR ELECTROPHOTOGRAPHY

FIELD OF THE INVENTION AND RELATED ART

The present invention relates to a photosensitive member for electrophotography, particularly to a photosensitive member for electrophotography having a photosensitive layer which is capable of constantly providing high-quality images in repeated use and is excellent in durability.

In recent years, a large number of photosensitive members for electrophotography using organic compounds as a photoconductor (or a photoconductive material) have been developed, and most of those used in practice take a form wherein the photoconductor is function-separated into a charge-generating material and a charge-transporting material.

Because such an electrophotographic photosensitive member using an organic photoconductor has flexibility in the material design, it is expected to have improved electrophotographic characteristics such as sensitivity and optical responsiveness. Further, the photosensitive member using the organic photoconductor also has a characteristic such that its photosensitive layer may easily be formed into a film and it may attain high productivity.

The electrophotographic photosensitive member is repeatedly subjected to various image-forming processes in an electrophotographic apparatus and is required to show stable electrophotographic characteristics in these processes. However, the above-mentioned electrophotographic photosensitive member using an organic photoconductor has a disadvantage such that, in repeated use, it is liable to cause image quality deterioration such as image density decrease due to a decrease in its chargeability, and image blurring due to a decrease in its surface resistance.

It is considered that such deterioration is largely attributable to the effect of corona discharge. More specifically, when a photosensitive member is used in a copying machine, it is continuously subjected to the atmosphere of the corona discharge. Therefore, it is considered that the organic photoconductor is deteriorated under the action of an active substance such as ozone, $NO_x$ and nitric acid produced by the corona discharge, together with use in repeated copying operations. Particularly, the photosensitive member using an organic photoconductor is mostly used under negative charging, and the negative corona charging produces a larger amount of ozone than that produced by positive charging. This is one of factors by which the photosensitive member using the organic photoconductor is liable to deteriorate as compared with other photosensitive members used under the positive charging.

Further, after the completion of copying operations, there occurs a so-called "downtime memory phenomenon" such that a portion of the photosensitive member disposed under a corona charger when rotation ends is deteriorated, and the chargeability of this portion is materially reduced. It is considered that such a downtime memory phenomenon is attributed to the effect of the above-mentioned active substances produced by the corona discharge.

Hitherto, in order to prevent the above-mentioned deterioration of an electrophotographic photosensitive member, there have been proposed several methods wherein various additives such as an antioxidant, an ultraviolet absorber, and an agent for preventing light-induced deterioration, are added to the photosensitive member (Japanese Laid-Open Patent Application (KOKAI) Nos. 122444/1982, 120260/1983, 156131/1986, 105151/1987, etc.).

However, these conventional electrophotographic photosensitive additives cannot sufficiently prevent electrophotographic member deterioration in practice, and cannot sufficiently suppress a decrease in the dark potential ($V_D$), i.e., charging potential. Further, when any of the above-mentioned additive are added to a photosensitive member, the additive per se may function as a trapping agent with respect to charge transfer to cause an increase in light potential ($V_L$), whereby the electrophotographic characteristics are rather deteriorated.

SUMMARY OF THE INVENTION

An object of the present invention is to provide an electrophotographic photosensitive member which is capable of preventing its deterioration due to an active substance such as ozone, $NO_x$ and nitric acid, without impairing its electrophotographic characteristics.

Another object of the present invention is to provide an electrophotographic photosensitive member which shows high potential-stability and is capable of constantly providing high-quality images even after repeated use.

As a result of our study, we have found that when at least two species of specific compounds are added to a photosensitive layer comprising an organic photoconductor, its deterioration is sufficiently prevented and the other electrophotographic characteristics are not impaired.

The photosensitive member for electrophotography according to the present invention is based on such a discovery and comprises: an electroconductive substrate, and a photosensitive layer disposed thereon comprising an organic photoconductor; the photosensitive layer containing, at least, a compound represented by the following formula (I):

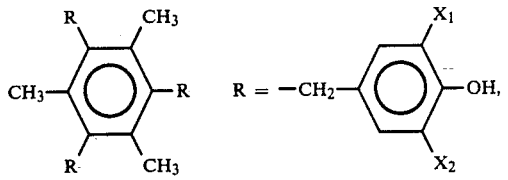

(I)

wherein $X_1$ denotes

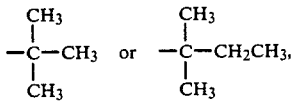

and $X_2$ denotes a hydrogen atom, an alkyl group having 1–10 carbon atoms or an alkenyl group having 2–10 carbon atoms; and a compound represented by the following formula (II):

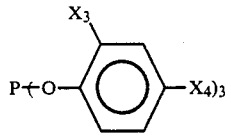

(II)

wherein $X_3$ and $X_4$ respectively denote an alkyl group having 1-10 carbon atoms or an alkenyl group having 2-10 carbon atoms.

The present invention also provides a photosensitive member for electrophotography comprising: an electroconductive substrate, and a photosensitive layer disposed thereon comprising an organic photoconductor; the photosensitive layer containing, at least, a compound represented by the following formula (I):

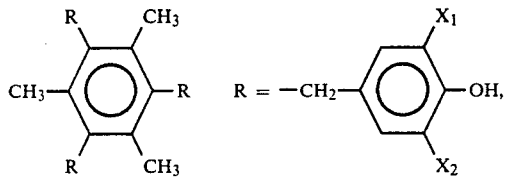

(I)

wherein $X_1$ denotes

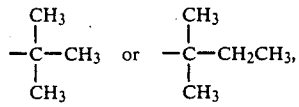

and $X_2$ denotes a hydrogen atom, an alkyl group having 1-10 carbon atoms or an alkenyl group having 2-10 carbon atoms;

a compound represented by the following formula (II):

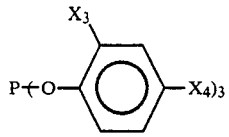

(II)

wherein $X_3$ and $X_4$ respectively denote an alkyl group having 1-10 carbon atoms or an alkenyl group having 2-10 carbon atoms; and a compound represented by the following formula (III):

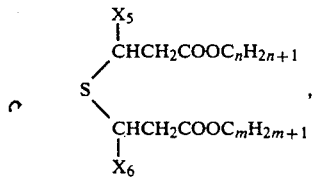

(III)

wherein n and m respectively denote an integer of 10-20, and $X_5$ and $X_6$ respectively denote a hydrogen atom or an alkyl group having 1-10 carbon atoms.

The present invention further provides a photosensitive member for electrophotography comprising: an electroconductive substrate, and a photosensitive layer disposed thereon comprising an organic photoconductor; the photosensitive layer containing, at least, a compound represented by the following formula (I):

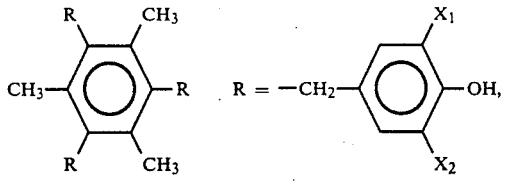

(I)

wherein $X_1$ denotes

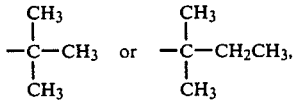

and $X_2$ denotes a hydrogen atom, an alkyl group having 1-10 carbon atoms or an alkenyl group having 2-10 carbon atoms;

a compound represented by the following formula (II):

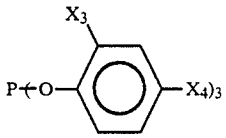

(II)

wherein $X_3$ and $X_4$ respectively denote an alkyl group having 1-10 carbon atoms or an alkenyl group having 2-10 carbon atoms;

a compound represented by the following formula (III):

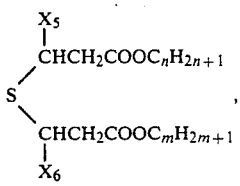

(III)

wherein n and m respectively denote an integer of 10-20, and $X_5$ and $X_6$ respectively denote a hydrogen atom or an alkyl group having 1-10 carbon atoms; and a compound represented by the following formula (IV):

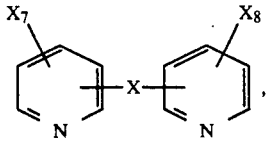

(IV)

wherein X denotes —S—, —S—S—, or $-(CH_2)_l$ or $-(CH{=}CH)_p-$, wherein l denotes an integer of 0-10, and p denotes an integer of 1-5, and $X_7$ and $X_8$ respectively denote a hydrogen atom, an alkyl group having 1-10 carbon atoms or an alkenyl group having 2 - 10 carbon atoms.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Hereinbelow, the present invention is described in detail.

Figure 1:
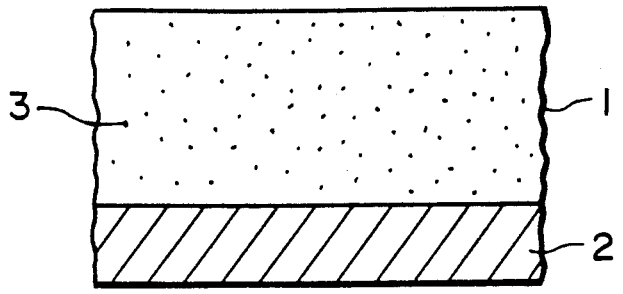
FIGS. 1 and 2 are schematic sectional views each showing a laminar structure of an embodiment of the electrophotographic photosensitive member according to the present invention.

Referring to FIG. 1, the electrophotographic photosensitive member according to the present invention comprises an electroconductive substrate 2 and a photosensitive layer 1 comprising an organic photoconductor and at least two species of specific additives.

In the present invention, as the above-mentioned two species of additives, there are simultaneously used a phenol derivative having three hindered phenol groups which is known as a radical scavenger or antioxidant used in plastic or rubber; and a phosphite compound which is known as a hydroperoxidedecomposing agent. Where these two species of compounds are simultaneously used, the deterioration prevention mechanism is not necessarily clear but it may be considered that these compounds show a synergistic effect on the prevention of photosensitive layer deterioration due to ozone or an active substance produced along the ozone, e.g., on the basis of the interaction between the hindered phenol group and the phosphite group.

Specific examples of the phenol derivative represented by the above-mentioned formula (I) used in the present invention may include: 1,3,5-trimethyl2,4,6-tris(3,5-di-t-butyl-4-hydroxybenzyl) benzene, 1,3,5-trimethyl-2,4,6-tris(3,5-di-t-amyl-4-hydroxybenzyl) benzene, 1,3,5-trimethyl-2,4,6-tris(3-t-butyl-5-methyl-4-hydroxybenzyl) benzene, 1,3,5-trimethyl-2,4,6-tris(3-t-amyl-5-isopropyl-4hydroxybenzyl) benzene, 1,3,5-trimethyl-2,4,6-tris(3-t-amyl-5-(1-butenyl)-4-hydroxybenzyl)benzene, etc. The group $X_2$ in the formula (I) may preferably be an alkyl group having 1–5 carbon atoms or an alkenyl group having 2–5 carbon atoms and may more preferably be

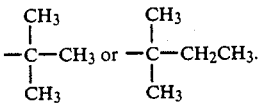

Specific examples of the phosphite compound represented by the above-mentioned formula (II) used in the present invention may include: tris (2,4-di-t-butylphenyl)phosphite, tris(2,4-di-t-amylphenyl) phosphite, tris(2-t-butyl-4-methylphenyl)-phosphite, tris(2-ethyl-4-methylphenyl)phosphite, tris(2-t-amyl-4-(1-butenyl)-phenyl)phosphite, etc.

Each of the groups $X_3$ and $X_4$ in the formula (II) may preferably be an alkyl group having 1–5 carbon atoms or an alkenyl group having 2–5 carbon atoms, and may more preferably be

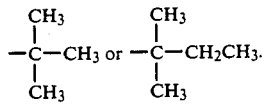

The total addition amount of these two species of compounds may preferably be 0.5–20%, and more preferably 2–15% based on the total weight of the photosensitive layer (not including the two species of compounds per se) to which the two species of compounds are added. The mixing weight ratio of (phenol compound (I)): (phosphite compound (II)) may preferably be 0.1:1 to 1:0.1, and more preferably, 0.3:1 to 1:0.3. When the above-mentioned total addition amount is below 0.5%, the deterioration prevention effect is not sufficient. When the total addition amount exceeds 20%, deleterious effect such as decrease in sensitivity and increase in residual potential is liable to occur.

In the present invention, when a sulfide compound represented by the above-mentioned formula (III), which is known as a hydroperoxide-decomposing agent is added to the photosensitive layer, in addition to the above-mentioned two species of compounds (I) and (II), better effect are achieved.

Specific examples of the sulfide compound (III) may include: dilauryl-3,3'-thiodipropionate, ditridecyl-3,3'-thiodipropionate, dimyristyl-3,3'-thiodipropionate, lauryl-stearyl-3,3'-thiodipropionate, distearyl-3,3'-thiodipropionate, distearyl-3,3'-methyl3,3'-thiodipropionate, distearyl-3-ethyl-3-methyl-3,3'-thiodipropionate, etc.

Each of the integers n and m in the formula (III) may preferably be an integer of 12–18, and each of the groups $X_5$ and $X_6$ may preferably be a hydrogen atom or an alkyl group having 1–4 carbon atoms. In a particularly preferred embodiment, $X_5$ and $X_6$ are respectively H (a hydrogen atom), and n and m are respectively an integer of 12, 14 or 18.

The total addition amount of these three species of compounds may preferably be 0.5–20%, and more preferably, 2–15% based on the total weight of a photosensitive layer (not including the three species of compounds) to which the three species of compounds are added. The mixing weight ratio of (phenol compound (I)): (phosphite compound (II)): (sulfide compound (III)) may preferably be 1:(0.2 to 5):(0.2 to 5), more preferably 1:(0.5 to 2):(0.5 to 2).

In the present invention, when a pyridine compound as a basic compound represented by the above-mentioned formula (IV) is added to the photosensitive layer, in addition to the above-mentioned three species of compounds (I), (II) and (III) (i.e., the above-mentioned four species of compounds (I) (II) (III) and (IV) are simultaneously used), further preferred effect are achieved.

In a case where these four species of compounds are simultaneously used, the deterioration prevention mechanism is not necessarily clear at present but it may be considered that these compounds show a synergistic effect on the prevention of photosensitive layer deterioration due to ozone or an active substance produced along therewith. More specifically, it may be considered that the interaction among the hindered phenol group, phosphite group and sulfide compound has an effect on a radical-type deteriorating factor such as ozone and $NO_x$ among those produced by conona discharge, and the pyridine compound as a basic compound scavenges an acidic substance, such as $HNO_3$ and $HNO_2$, among the deteriorating substances.

Specific examples of the pyridine compound represented by the above-mentioned formula (IV) used in the present invention may include: 2,2'-bipyridyl, 4,4'-bipyridyl, 1,2-di(2-pyridyl)ethane, 1,3-di-4pyridylpropane, di-2-pyridylsulfide, di-2-pyridyl-disulfide, 1,2-di-4-pyridylethylene, 5-t-butyl-2(3'-ethyl-2'-pyridyl)pyridine, 5-methyl-2(5'-ethyl-2'-pyridyl)pyridine, 5-isopropyl-2(2'-butenyl-4'-pyridyl)pyridine, etc.

In a preferred embodiment, in the formula (IV), 1 is an integer of 0–4, p is an integer of 1–3, $X_7$ and $X_8$ are respectively H (hydrogen atom), an alkyl group having 1–4 carbon atoms, or an alkenyl group having 2–4 carbon atoms. In a particularly preferred embodiment, x is $-(CH_2)_l-$wherein 1 is an integer of 0–3, and $X_7$ and $X_8$ are respectively H (hydrogen atom).

The total addition amount of these four species of compounds may preferably be 0.5–20%, and more preferably 2–15% based on the total weight of a photosensitive layer (not including the four species of compounds) to which the four species of compounds are added. The mixing weight ratio of (phenol compound (I)): (phosphite compound (II)) (sulfide compound (III)):(pyridine compound (IV)) may preferably be 1:(0.2 to 5):(0.2 to 5):(0.05 to 2), and more preferably, 1:(0.5 to 2):(0.5 to 2):(0.1 to 1). When the above-mentioned total addition amount is below 0.5%, the deterioration prevention effect is not sufficient. When the total addition amount exceeds 20%, deleterious effect such as decrease in sensitivity and increase in residual potential are liable to occur.

Figure 2:
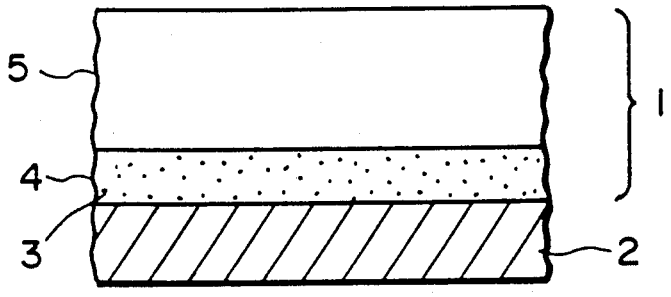

In the present invention, the photosensitive layer 1 comprising an organic photoconductor is disposed on an electroconductive substrate 2, as shown in FIG. 1. The photosensitive layer 1 may take a single layer form as shown in FIG. 1, or a laminate layer form as shown in FIG. 2, etc. In the embodiment shown in FIG. 1, the photosensitive layer 1 comprises a charge-generating material 3 and a charge-transporting material (not shown) which is function-separated from the charge-generating material 3 and mixed in the same layer as the charge-generating material 3. In the embodiment shown in FIG. 2, the photosensitive layer 1 comprises a charge generation layer 4 comprising a charge-generating material 3, and a charge transport layer 5 comprising a charge-transporting material (not shown).

The charge-generating material to be used in the present invention may be an organic photoconductor such as pyrylium or thiopyrylium-type dye, phthalocyanine-type pigment, anthanthrone pigment, perylene pigment, dibenzpyrene-quinone pigment, pyranthrone pigment, azo pigment, indigo pigment, and quinacridone-type pigment.

The charge-transporting material to be used in the present invention may be an organic photoconductor such as pyrazoline-type compound, hydrazone-type compound, stilbene-type compound, triphenylamine-type compound, benzidine-type compound, oxazole-type compound, indole-type compound, and carbazole-type compound.

In the case of a single layer-type photosensitive layer 1 as shown in FIG. 1, a coating liquid obtained by dissolving or dispersing the above-mentioned charge-generating material 3 and charge-transporting material in a solvent, together with an appropriate binder resin as desired, is applied onto an electroconductive substrate 2 and then dried, thereby forming the photosensitive layer 1, In such an embodiment, the thickness of the photosensitive layer 1 may preferably be 8–40 microns, more preferably 10–30 microns. The above-mentioned additives according to the present invention are contained in the single layer-type photosensitive layer 1.

In an embodiment wherein the photosensitive layer 1 is a laminate-type comprising plural layers, the photosensitive member according to the present invention comprises: (1) an electroconductive substrate 2, and a charge generation layer 4 and a charge transport layer 5 disposed in this order on the substrate 2 as shown in FIG. 2; or (2) an electroconductive substrate, and a charge transport layer and a charge generation layer disposed in this order on the substrate (not shown).

In the case of (1), a coating liquid obtained by dissolving or dispersing a charge-generating material 3 in a solvent, together with a binder resin as desired, is applied onto a conductive substrate 2 and then dried, thereby to form a charge generation layer 4. The charge generation layer 4 may also be formed by vacuum vapor deposition such as vacuum evaporation and sputtering. The thickness of the charge generation layer 4 may preferably be 5 microns or below, more preferably 0.01–3 microns. In such an embodiment, the charge generation layer 4 can be formed by using an inorganic photoconductor such as selenium and amorphous silicon.

The charge transport layer 5 may be disposed on the above-mentioned charge generation layer 4 by use of a coating liquid obtained by dissolving or dispersing the above-mentioned charge-transporting material in a solvent, together with a binder resin having a film-formability as desired. The thickness of the charge transport layer 5 may preferably be 5–40 microns, more preferably 8–35 microns. In such an embodiment, the above-mentioned additives according to the present invention may preferably be contained in the charge transport layer 5.

In the case of (2) wherein the charge generation layer 4 is disposed on the charge transport layer 5, these layers may be formed by the application of the above-mentioned organic photoconductor (i.e., a charge-generating material or charge-transporting material), together with a binder resin as desired. In such an embodiment, it is preferred that the charge-transporting material is also contained in the charge generation layer 4. In such an embodiment, the above-mentioned additives according to the present invention may preferably be contained in the charge generation layer 4 or both of the charge generation layer 4 and the charge transport layer 5.

The electroconductive substrate or support 2 may be a known one including a member in the form of a cylinder or a belt comprising a metal such as aluminum, an aluminum alloy, iron, and copper; a member comprising such a metal and having thereon an electroconductive layer; or a member comprising a plastic film having thereon a vapor-deposited metal layer.

In the present invention, an intermediate layer such as adhesive layer, barrier layer or smoothing layer may be disposed, as desired, between the conductive substrate 2 and the photosensitive layer 1.

In the electrophotographic photosensitive member according to the present invention, a lubricant including lubricant powder such as fluorine-containing resin powder, polyolefin-type resin powder, and silicone-type resin powder can be added to the photosensitive layer 1. In such an embodiment wherein the above-mentioned additives (i.e., compound (I) and (II)) are used in the photosensitive layer 1 in combination with the lubricant, better effect is achieved with respect to both of chemical deterioration and physical deterioration.

The electrophotographic photosensitive member according to the present invention may be used in ordinary copying machines and may also be used as a photosensitive member in various apparatus such as laser beam printer, LED printer, LCD printer and CRT printer to which an electrophotographic process is applied.

The present invention will be explained more specifically with reference to the following examples.

EXAMPLE 1

A 5% solution of a polyamide resin (trade name: Amilan CM-8000, mfd. by Toray K.K.) in methanol was applied onto an electroconductive substrate of an aluminum cylinder having a diameter of 80 mm and a length of 360 mm by dip coating and then dried, thereby forming a 0.5 micron-thick primer (or undercoat) layer.

Next, 10 parts (parts by weight, the same in the description appearing hereinafter) of a trisazo pigment represented by the following structural formula, and 6 parts of a polyvinyl butyral resin (tradename:S LEC BL-S, and made by Sekisui Kagaku K.K.) were dispersed in 50 parts of cyclohexanone by means of a sand mill using glass beads.

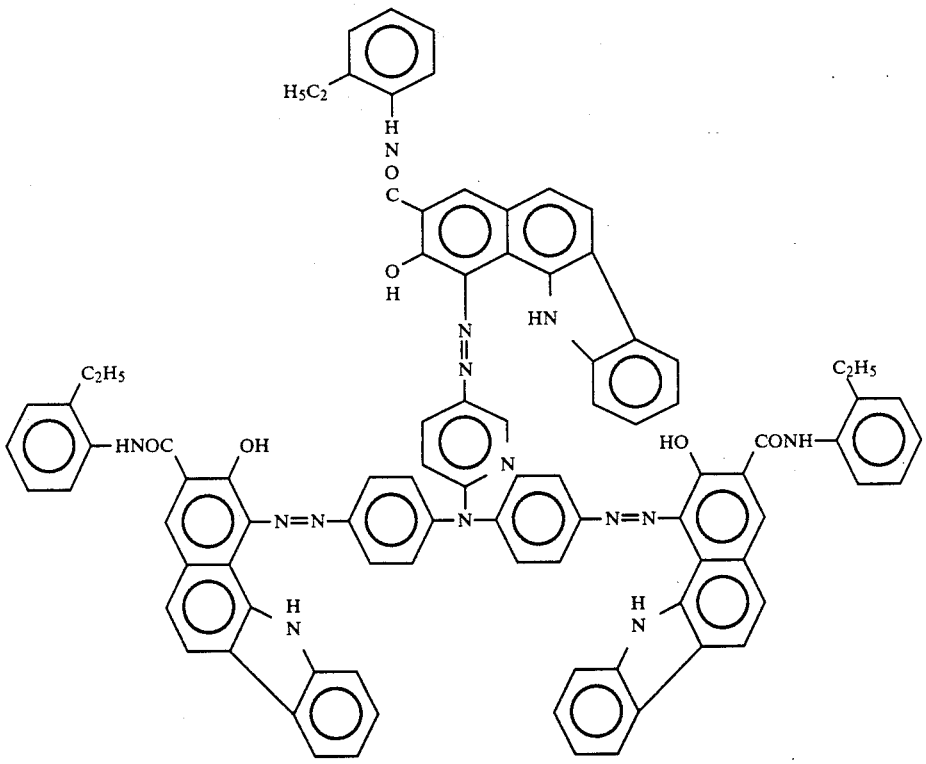

To the resultant dispersion, 100 parts of methyl ethyl ketone was added, and then the dispersion was applied onto the above-mentioned primer layer and dried, thereby forming a 0.2 micron-thick charge generation layer.

Then, 10 parts of a stilbene compound represented by the following structural formula, and 10 parts of a polycarbonate resin (Panlite L-1250, mfd. by Teijin Kasei K.K.) were dissolved in 50 parts of dichloromethane and 10 parts of monochlorobenzene, thereby to prepare a coating liquid for a charge transport layer.

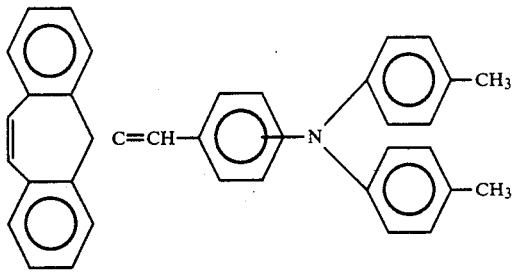

To the resultant coating liquid, 1,3,5-trimethyl-2,4,6-tris(3,5,-di-t-butyl-4-hydroxybenzyl) benzene (THBZ-1) represented by the following structural formula (trade name: Irganox 1330, made by Nihon Ciba-Geigy K.K.):

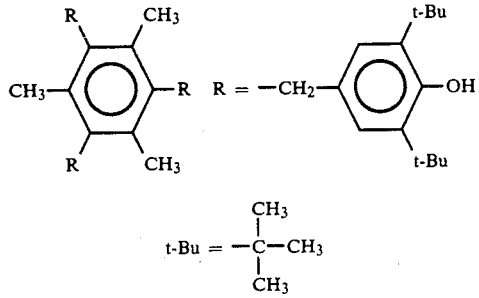

and tris(2,4-di-t-butylphenyl) phosphite (TBP-1) represented by the following formula (trade name: Irgafos 168, made by Nihon Ciba-Geigy K.K.):

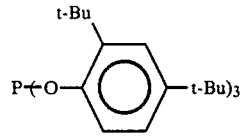

were added in various addition amounts as shown in Table 1 appearing hereinafter, thereby forming six species of coating liquids. More specifically, the total addition amount was 0.4 part or 2 part, and the mixing ratio was 1:1, 0.5:1, and 1:0.5 with respect to the respective addition amounts.

Each of the thus prepared six species of coating liquids was applied onto the above-mentioned charge generation layer to form a 18 micron-thick charge transport layer, whereby six species of photosensitive member Nos. 1 to 6 as shown in Table 1 were obtained.

Further, five species of photosensitive member Nos. 7–11 as comparative samples as shown in Table 1 were prepared in the following manner. More specifically, the photosensitive member No. 7 was prepared by using no additive, the photosensitive member Nos. 8 and 9 were prepared by adding THBZ-1 alone in amounts of 0.4 part and 2 parts, respectively, and the photosensitive member Nos. 10 and 11 were prepared by adding TBP-1 alone in amounts of 0.4 part and 2 parts, respectively.

Each of the thus prepared photosensitive member Nos. 1–11 was assembled in an electrophotographic copying machine (trade name: CLC 1, mfd. by Canon K.K.) and the characteristics thereof were evaluated in the following manner.

Thus, a latent image was formed on the photosensitive member under a condition such that the dark potential ($V_D$) of the photosensitive member was −650 V and the light potential ($V_L$) thereof was −150 V. The light quantity (lux.sec) for image exposure providing such a latent image was measured and defined as "initial sensitivity". Then, after successive copying of 5,000 sheets, the above-mentioned potentials $V_D$ and $V_L$ were measured and the decrease rate (%) in $V_D$ and increase (V) in $V_L$ on the basis of the above-mentioned initial values were determined.

Thereafter, the photosensitive member was left standing in the copying machine for 10 hours, and the surface potential of the photosensitive member was measured. At this time, a portion of the photosensitive member disposed under a corona charger was marked and the difference in $V_D$ ($\Delta V_D$) between this portion and the other portion was determined.

Further, successive copying of 5,000 sheets (10,000 sheets in total) was conducted and then the above-mentioned measurements were conducted in the same manner as in the case of the successive copying of 5,000 sheets. In this case, $\Delta V_D$ was measured so that the portion of the photosensitive member disposed under the corona charger was the same as that used in the case of the successive copying of 5,000 sheets. The thus obtained results are shown in the following Table 1.

Further, photosensitive member Nos. 12–18 were prepared by variously changing the mixing ratio and addition amount of the additives as shown in Table 2 appearing hereinafter, and the above-mentioned evaluations were conducted. The results are shown in Table 2. In the above-mentioned Tables 1 and 2, the addition amount of the additive is the weight ratio thereof to the total weight of the photosensitive layer (not including the additive per se), i.e., the weight of the charge transport layer in this instance.

TABLE 1

| Photo-sensitive member | Addition amount (%) | Mixing ratio (THBZ-1/TBP-1) | Initial sensitivity (lux · sec) | Decrease rate in $V_D$ (%) | | Increase in $V_L$ (V) | | $\Delta V_D$ after standing (V) | |
|---|---|---|---|---|---|---|---|---|---|
| | | | | 5000 sheets | 10000 sheets | 5000 sheets | 10000 sheets | 5000 sheets | 10000 sheets |
| 1 | 2 | 1/1 | 3.0 | 3.3 | 3.4 | 10 | 20 | 8 | 10 |
| 2 | 10 | 1/1 | 3.2 | 2.0 | 2.2 | 20 | 30 | 5 | 5 |
| 3 | 2 | 0.5/1 | 3.0 | 3.4 | 3.6 | 10 | 20 | 9 | 10 |
| 4 | 10 | 0.5/1 | 3.2 | 2.2 | 2.3 | 20 | 30 | 5 | 5 |
| 5 | 2 | 1/0.5 | 3.0 | 3.0 | 3.2 | 10 | 20 | 7 | 10 |
| 6 | 10 | 1/0.5 | 3.2 | 2.1 | 2.2 | 20 | 30 | 5 | 5 |
| 7 | 0 | — | 3.0 | 34.0 | 43.0 | 10 | 20 | 80 | 120 |
| 8 | 2 | 1/0 | 3.0 | 5.3 | 13.0 | 10 | 20 | 10 | 45 |
| 9 | 10 | 1/0 | 3.2 | 4.5 | 11.5 | 30 | 35 | 10 | 30 |
| 10 | 2 | 0/1 | 3.0 | 25 | 40.0 | 10 | 20 | 60 | 80 |
| 11 | 10 | 0/1 | 3.2 | 20.3 | 35.2 | 10 | 20 | 40 | 60 |

TABLE 2

| Photo-sensitive member | Addition amount (%) | Mixing ratio (THBZ-1/TBP-1) | Initial sensitivity (lux · sec) | Decrease rate in $V_D$ (%) | | Increase in $V_L$ (V) | | $\Delta V_D$ after standing (V) | |
|---|---|---|---|---|---|---|---|---|---|
| | | | | 5000 sheets | 10000 sheets | 5000 sheets | 10000 sheets | 5000 sheets | 10000 sheets |
| 12 | 0.5 | 1/1 | 3.0 | 5.5 | 6.8 | 10 | 20 | 15 | 20 |
| 13 | 15 | 1/1 | 3.3 | 1.5 | 1.5 | 25 | 35 | 5 | 5 |
| 14 | 20 | 1/1 | 4.3 | 0.5 | 1.0 | 30 | 35 | 5 | 5 |
| 15 | 10 | 1/0.1 | 3.2 | 3.2 | 3.3 | 20 | 30 | 7 | 10 |
| 16 | 10 | 1/0.3 | 3.3 | 2.2 | 2.4 | 20 | 30 | 5 | 5 |
| 17 | 10 | 0.3/1 | 3.3 | 2.9 | 3.0 | 20 | 30 | 5 | 7 |
| 18 | 10 | 0.1/1 | 3.2 | 3.5 | 3.7 | 20 | 30 | 9 | 10 |

As apparent from the above Tables 1 and 2, in the photosensitive members according to the present invention wherein the photosensitive layer contains specific two species of additives, the decrease in the dark part potential is small and the effect on the prevention of deterioration is excellent, in a successive electrophotographic process. Particularly, the deterioration in a photosensitive member portion disposed under a corona charger is very little. Further, ill effect on the electrophotographic characteristic such as an increase in the light part potential is substantially none.

On the contrary, in the photosensitive members not containing the above-mentioned additive, the dark park potential is considerably decreased due to deterioration, and the photosensitive member portion disposed under the corona charger is also considerably deteriorated, in a successive electrophotographic process. Further, when either one of the specific two species of additives is added, somewhat improvement in deterioration is effected as compared with the case of a photosensitive member containing no additive, but such improvement is not sufficient as compared with the photosensitive member according to the present invention.

EXAMPLE 2

A primer layer was formed on an electroconductive substrate by coating in the same manner as in Example 1.

Separately, 10 parts of a disazo pigment represented by the following structural formula, and 6 parts of a polyvinyl butyral resin (S-LEC BX-1, mfd. by Sekisui Kagaku K.K.) were dispersed in 50 parts of cyclohexanone by means of a sand mill using glass beads.

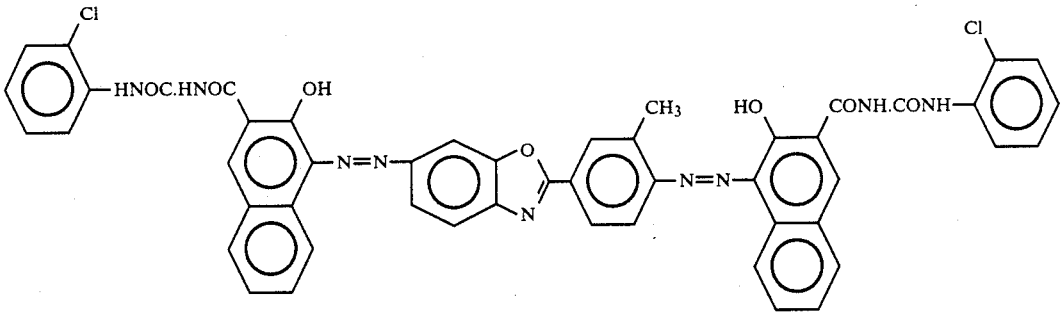

To the resultant dispersion, 100 parts of tetrahydrofuran was added, and then the dispersion was applied onto the primer layer and dried thereby to form a 0.2 micron-thick charge generation layer.

Then, 8 parts of a benzocarbazole compound represented by the following structural formula, and 10 parts of a styrene-acrylic copolymer resin (Estyrene MS-200, mfd. by Shin-Nihon Seitetsu Kagaku K.K.),

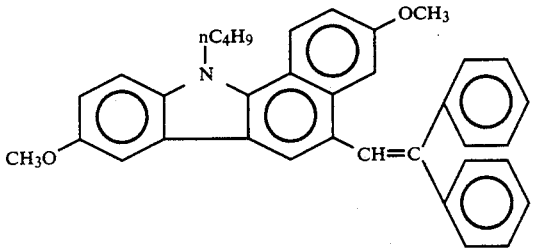

0.36 part of 1,3,5-trimethyl-2,4,6-tris(3,5-di-t-amyl-5-hydroxybenzyl) benzene (THBZ-2):

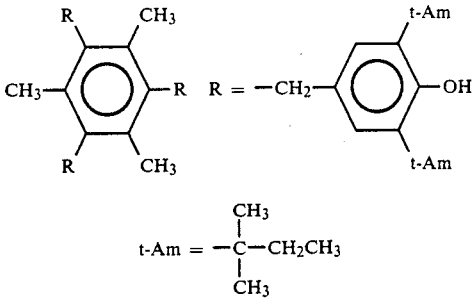

and 0.36 part of tris(2,4-di-t-amylphenyl)phosphite (TBP-2) (i.e., total amount of additives=0.72 part, mixing ratio=1:1):

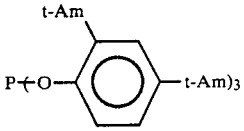

were dissolved in 15 parts of dichloromethane and 45 parts of monochlorobenzene, thereby to prepare a coating liquid for a charge transport layer. The thus prepared coating liquid was then applied onto the above-mentioned charge generation layer to form a 18 micron-thick charge transport layer, whereby a photosensitive member No. 19 was prepared.

On the other hand a comparative photosensitive member No. 20 was prepared in the same manner as described above except for using no THBZ-2 or TBP-2. Further, comparative photosensitive member Nos. 21–34 were prepared in the same manner as described above except for using an additive as shown in the following Table 3, singly or as a mixture (mixing ratio=1:1).

TABLE 3

| Photosensitive member No. | Additive |
|---|---|
| 21 | 2,2'-butylidene-bis(2-t-butyl-4-methylphenol) (BTP): 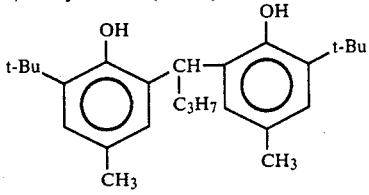 (Sunilzer, BBP mfd. by Sumitomo Kagaku Kogyo K.K.) |
| 22 | bis[2-methyl-4-(3-n-alkyl-thiopropionyloxy)- |

TABLE 3-continued

| Photo-sensitive member No. | Additive |
|---|---|
| | 5-t-butylphenyl]sulfide (BT): |

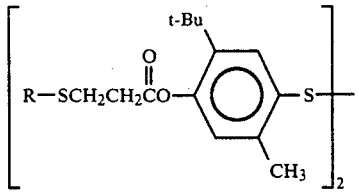

| | |
|---|---|
| | R: an alkyl group having 12–14 carbon atoms (MARK Ao-23: mfd. by Adeka-Argus Chemical Co.) |
| 23 | 2,2'-thiobis(4-methyl-6-t-butylphenol) (TMP): |

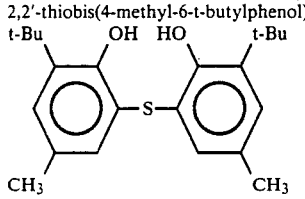

| | |
|---|---|
| | (IRGANOX 1081: mfd. by Nihon Ciba-Geigy K.K.) |
| 24 | 2,4,6-tri-t-butylphenol(TBP): |

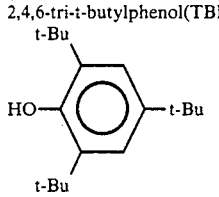

| | |
|---|---|
| | Antioxidant, Hoechst TMOZ: mfd. by Hoechst Japan K.K.) |
| 25 | phenyl-4-piperidylcarbonate (PPC): |

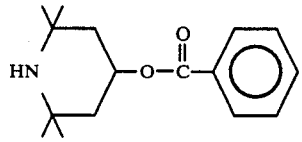

| | |
|---|---|
| | (Tinuvin 744: mfd. by Nihon Ciba-Geigy K.K.) |
| 26 | 4-t-butylphenyl salicylate (BPS): |

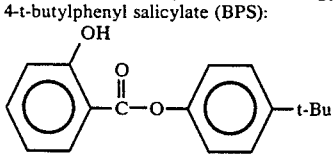

| | |
|---|---|
| | (Tinuvin 120: mfd. by Nihon Ciba Geigy K.K.) |
| 27 | diphenyltridecylphosphite (P-DTP): |

TABLE 3-continued

| Photo-sensitive member No. | Additive |
|---|---|

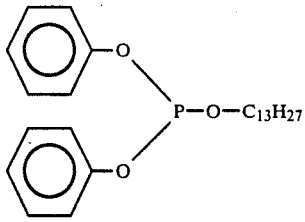

| | |
|---|---|
| | (MARK 1013: mfd. by Adeka-Argus Chemical Co.) |
| 28 | BTP/BT |
| 29 | THBZ-2/BT |
| 30 | BTP/TBP-2 |
| 31 | THBZ-1/TMP |
| 32 | TBP/TBP-2 |
| 33 | THBZ-2/PPC |
| 34 | THBZ-1/BPS |

With respect to the thus prepared photosensitive member Nos. 21–34, electrophotographic characteristics were evaluated in the same manner as in Example 1. Further, the light quantity providing initial potentials of $V_D = -650$ V and $V_L = -150$ V was measured. The results are shown in The following Table 4.

TABLE 4

| Photosensitive member | Initial sensitivity (lux · sec) | Decrease rate in $V_D$ (%) 5000 sheets | Decrease rate in $V_D$ (%) 10000 sheets | Increase in $V_L$ (V) 5000 sheets | Increase in $V_L$ (V) 10000 sheets | $\Delta V_D$ after standing (V) 5000 sheets | $\Delta V_D$ after standing (V) 10000 sheets |
|---|---|---|---|---|---|---|---|
| 19 | 2.8 | 2.0 | 2.2 | 20 | 25 | 5 | 5 |
| 20 | 2.8 | 32.0 | 40.0 | 15 | 20 | 100 | 110 |
| 21 | 2.8 | 24.0 | 29.0 | 15 | 20 | 85 | 90 |
| 22 | 2.9 | 26.0 | 30.0 | 15 | 25 | 65 | 100 |
| 23 | 3.8 | 20.0 | 26.8 | 25 | 40 | 45 | 65 |
| 24 | 4.0 | 26.0 | 31.5 | 15 | 20 | 65 | 95 |
| 25 | 3.6 | 15.0 | 20.0 | 25 | 35 | 45 | 70 |
| 26 | 3.7 | 25.0 | 31.5 | 35 | 60 | 40 | 55 |
| 27 | 2.9 | 23.1 | 28.5 | 15 | 20 | 70 | 90 |
| 28 | 3.0 | 25.0 | 31.5 | 20 | 30 | 60 | 90 |
| 29 | 3.1 | 8.5 | 12.0 | 20 | 30 | 20 | 25 |
| 30 | 3.1 | 20.0 | 30.0 | 15 | 20 | 45 | 60 |
| 31 | 3.6 | 6.5 | 10.0 | 35 | 45 | 15 | 20 |
| 32 | 3.9 | 25.5 | 30.5 | 15 | 15 | 60 | 70 |
| 33 | 3.3 | 8.3 | 11.0 | 20 | 25 | 20 | 30 |
| 34 | 3.5 | 7.5 | 10.3 | 30 | 50 | 20 | 25 |

As shown in the above Table 4, the photosensitive member containing specific two species of additives according to the present invention provides a small change in the potential and is excellent in prevention of deterioration. On the contrary, when another additive or another combination of additives is used, the prevention of deterioration is not sufficient or ill effect becomes considerable.

EXAMPLE 3

A primer layer was formed on an electroconductive substrate by coating in the same manner as in Example 1.

Separately, 15 parts of a stilbene compound represented by the following structural formula, and 10 parts of a polycarbonate resin (Panlite L-1250, mfd. by Teijin Kasei K.K.) were dissolved in 50 parts of dichloromethane and 10 parts of monochlorobenzene, thereby to prepare a coating liquid for a charge transport layer. The thus prepared coating liquid was applied onto the primer layer to form a 15 micron-thick charge transport layer.

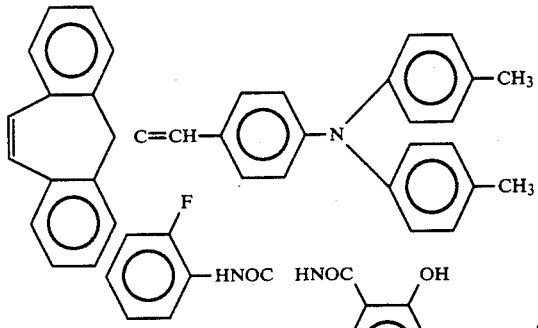

Then, 4 parts of a disazo pigment represented by the following structural formula:

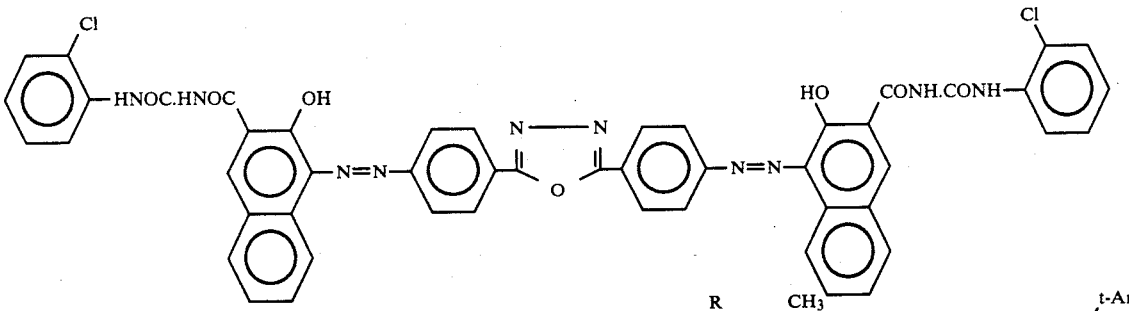

7 parts of the above-mentioned stilbene compound, 10 parts of the above-mentioned polycarbonate resin, 0.315 part of THBZ-1, and 0.315 part of TBP-1 (total amount of additives=0.63 part, mixing ratio=1:1) were dissolved or dispersed in 150 parts of dichloromethane and 50 parts of monochlorobenzene to form a coating liquid.

The thus prepared coating liquid was then applied onto the above-mentioned charge transport layer by spraying to form a 5 micron-thick charge generation layer, whereby a photosensitive member No. 35 was prepared.

On the other hand a comparative photosensitive member No. 36 was prepared in the same manner as described above except for using no THBZ-1 or TBP-1.1

The thus prepared photosensitive members were evaluated in the same manner as described hereinabove except that evaluation conditions were set so that $V_D$=650 V and $V_L$=+150 V were provided under positive charging. The results are shown in Table 5 appearing hereinafter.

EXAMPLE 4

A primer layer was formed on an electroconductive substrate by coating in the same manner as in Example 1.

Separately, 1 parts of a disazo pigment represented by the following structural formula:

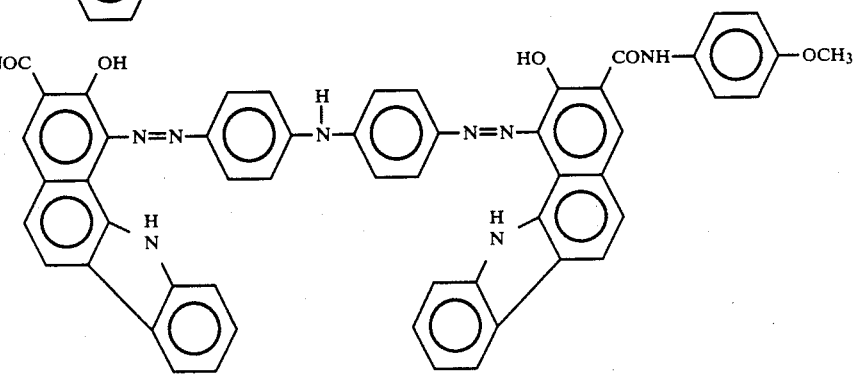

10 parts of the benzocarbazole compound used in Example 2, 10 parts of a polycarbonate resin (Panlite L-1250, mfd. by Teijin Kasei K.K.), 0.15 part of 1,3,5-trimethyl-2,4,6-tris(3-t-amyl-5-t-butyl-4-hydroxybenzyl) benzene (THBZ-3):

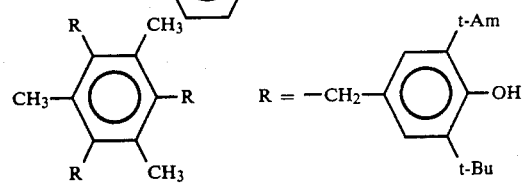

and 0.15 part of tris (2-t-amyl-4-t-butylphenyl)-phosphite (TBP-3) (i.e., total amount of additives=0.3 part, mixing ratio=1:1):

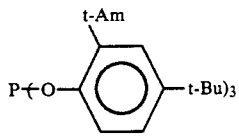

were dissolved or dispersed in 60 parts of dichloromethane and 20 parts of monochlorobenzene, thereby to prepare a coating liquid. The thus prepared coating liquid was then applied onto the above-mentioned primer layer to form a 16 micron-thick photosensitive layer, whereby a photosensitive member No. 37 was prepared.

On the other hand a comparative photosensitive member No. 38 was prepared in the same manner as described above except for using no THBZ-3 or TBP-3.

The thus prepared photosensitive members were evaluated in the same manner as in Example 3. The results are shown in the following Table 5.

TABLE 5

| Photo-sensitive member | Decrease rate in $V_D$ (%) | | Increase in in $V_L$ (V) | | $\Delta V_D$ after standing (V) | |
|---|---|---|---|---|---|---|
| | 5000 sheets | 10000 sheets | 5000 sheets | 10000 sheets | 5000 sheets | 10000 sheets |
| 35 | 2.1 | 2.3 | 15 | 25 | 5 | 5 |
| 36 | 35.8 | 45.0 | 10 | 20 | 120 | 130 |
| 37 | 2.4 | 2.6 | 20 | 25 | 5 | 5 |
| 38 | 29.1 | 40.0 | 20 | 30 | 100 | 120 |

EXAMPLE 5

Photosensitive member Nos. 39–47 were prepared in the same manner as in Example 1 except for using two species of additives as shown in the following Table 6 in a mixture (mixing ratio=1:1, total addition amount=10%). The results are shown in Table 7 appearing hereinafter.

TABLE 6

| Abbreviation | Additive |
|---|---|
| THBZ-4 | 1,3,5-trimethyl-2,4,6-tris(3-t-butyl-5-methyl-4-hydroxybenzyl)benzene 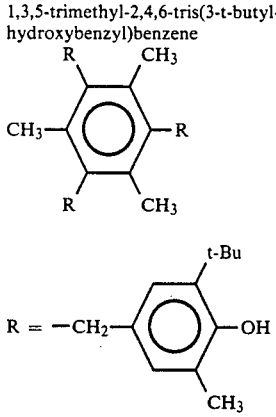 |
| THBZ-5 | 1,3,5-trimethyl-2,4,6-tris(3-t-amyl-5-isopropyl-4-hydroxybenzyl)benzene  |
| THBZ-6 | 1,3,5-trimethyl-2,4,6-tris(3-t-amyl-5-(1-butenyl)-4-hydroxybenzyl)benzene 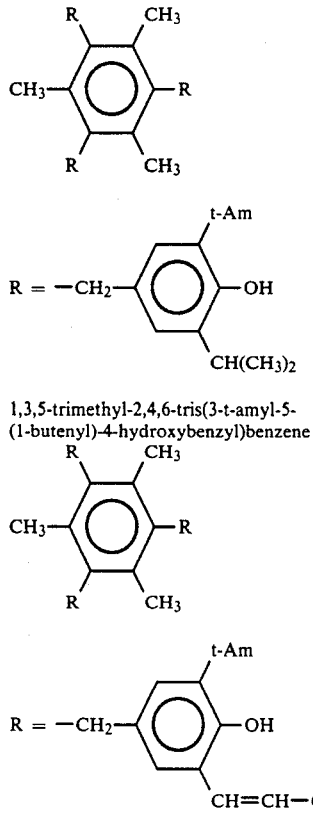 |
| TBP-4 | tris(2-t-butyl-4-methylphenyl)phosphite 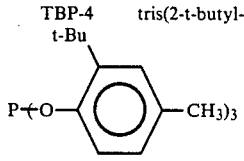 |
| TBP-5 | tris(2-ethyl-4-methylphenyl)phosphite 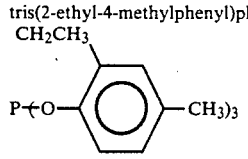 |
| TBP-6 | tris(2-t-amyl-4-(1-butenyl)phenyl)phosphite 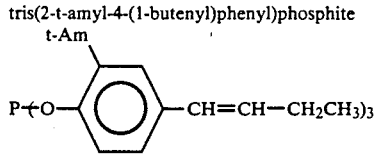 |

TABLE 7

| Photo-sensitive member | Additive mixture | Initial sensitivity (lux · sec) | Decrease rate in $V_D$ (%) | | Increase in $V_L$ (V) | | $\Delta V_D$ after standing (V) | |
|---|---|---|---|---|---|---|---|---|
| | | | 5000 sheets | 10000 sheets | 5000 sheets | 10000 sheets | 5000 sheets | 10000 sheets |
| 39 | THBZ-4/TBP-4 | 3.1 | 2.0 | 2.5 | 10 | 20 | 5 | 5 |
| 40 | THBZ-4/TBP-5 | 3.1 | 2.0 | 2.4 | 10 | 20 | 5 | 6 |
| 41 | THBZ-4/TBP-6 | 3.2 | 1.9 | 2.2 | 10 | 20 | 5 | 6 |
| 42 | THBZ-5/TBP-4 | 3.2 | 1.9 | 2.2 | 15 | 25 | 5 | 7 |
| 43 | THBZ-5/TBP-5 | 3.2 | 2.1 | 2.4 | 15 | 20 | 5 | 7 |
| 44 | THBZ-5/TBP-6 | 3.3 | 2.2 | 2.6 | 20 | 30 | 5 | 5 |
| 45 | THBZ-6/TBP-4 | 3.2 | 2.0 | 2.2 | 15 | 20 | 5 | 5 |
| 46 | THBZ-6/TBP-5 | 3.4 | 2.1 | 2.4 | 10 | 20 | 5 | 7 |

TABLE 7-continued

| Photo-sensitive member | Additive mixture | Initial sensitivity (lux · sec) | Decrease rate in $V_D$ (%) | | Increase in $V_L$ (V) | | $\Delta V_D$ after standing (V) | |
|---|---|---|---|---|---|---|---|---|
| | | | 5000 sheets | 10000 sheets | 5000 sheets | 10000 sheets | 5000 sheets | 10000 sheets |
| 47 | THBZ-6/TBP-6 | 3.3 | 2.2 | 2.7 | 15 | 20 | 5 | 5 |

EXAMPLE 6

A photosensitive member No. 48 was prepared in the same manner as in Example 1 except that 1,3,5-trimethyl-2,4,6-tris(3,5-di-t-butyl-4hydroxybenzyl)benzene (THBZ-1), tris(2,4-di-t-butylphenyl)phosphite (TBP-1), and distearyl-3,3'-thiodipropionate (TP-1):

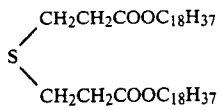

(Sumilizer TPS: mfd. by Sumitomo Kagaku Kogyo K.K.) were used as additives at a mixing ratio of 1:1:2 and in a total addition amount of 10%.

Further, a photosensitive member No. 49 was prepared in the same manner as described above except that dimyristyl-3,3'-thiodipropionate (TP-2):

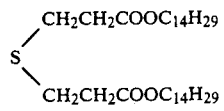

(Sumilizer TPM: mfd. by Sumitomo Kagaku Kogyo K.K.) was used instead of the above-mentioned TP-1.

Further, a photosensitive member No. 50 was prepared in the same manner as described above except that lauryl-stearyl-3,3'-thiodipropionate (TP-3):

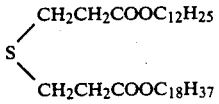

(Cyarox 1212: mfd. by ACC)

was used instead of the above-mentioned TP-1.

Further, photosensitive member Nos. 51 and 52 were prepared in the same manner as in the preparation of the photosensitive member No. 48 except that the mixing ratio of the above-mentioned three species of additives were 1:0.8:1.5, and 1:1.5:0.8, respectively.

The thus prepared photosensitive members were evaluated in the same manner as in Example 1. The results are shown in the following Table 8. In Table 8, the results of evaluation of the photosensitive member No. 2 containing two species of additives (THBZ-1 and TBP-1), and those of a photosensitive member No. 53 containing 10% of TP-1 alone are inclusively shown.

TABLE 8

| Photosensitive member | Initial sensitivity (lux · sec) | Decrease rate in $V_D$ (%) | | Increase in $V_L$ (V) | | $\Delta V_D$ after standing (V) | |
|---|---|---|---|---|---|---|---|
| | | 5000 sheets | 10000 sheets | 5000 sheets | 10000 sheets | 5000 sheets | 10000 sheets |
| 48 | 3.4 | 1.0 | 1.0 | 25 | 30 | 0* | 0* |
| 49 | 3.5 | 1.1 | 1.1 | 20 | 30 | 0* | 0* |
| 50 | 3.5 | 1.1 | 1.2 | 25 | 35 | 0* | 5 |
| 51 | 3.5 | 1.1 | 1.2 | 25 | 35 | 0* | 5 |
| 52 | 3.4 | 1.1 | 1.2 | 25 | 30 | 0* | 5 |
| 2 | 3.2 | 2.0 | 2.2 | 20 | 30 | 5 | 5 |
| 7 | 3.0 | 34.0 | 43.0 | 10 | 25 | 80 | 120 |
| 53 | 3.2 | 30.0 | 40.2 | 10 | 30 | 75 | 100 |

*: Substantially none

As described above, when a specific additive is added to a photosensitive layer in addition to the above-mentioned two species of additives according to the present invention, the decrease in the dark part potential is further reduced and the deterioration in a photosensitive member portion disposed under a corona charger is further suppressed.

EXAMPLE 7

The photosensitive member No. 2, 7 and 19 prepared in Examples 1 and 2, and the photosensitive member No. 48 prepared in Example 6, were further subjected to 40,000 sheets of copying in addition to 10,000 sheets of copying conducted in the above-mentioned evaluation.

As a result, with respect to the photosensitive member Nos. 2, 19 and 48 containing the specific additives, even after the above-mentioned 50,000 sheets of copying, there was substantially no decrease in image quality as compared with the initial stage, and there were obtained images stably retaining a high contrast and being free of unevenness. On the other hand, with respect to the photosensitive member No. 7, the image density was remarkably decreased at the time of about 15,000 sheets of successive copying. Further, in the photosensitive member No. 7, only images with considerable unevenness were obtained due to potential decrease which was caused in downtime after completion of copying.

EXAMPLE 8

A 5% solution of a polyamide resin (trade name: Amilan CM-8000, mfd. by Toray K.K.) in methanol was applied onto an electroconductive substrate of an aluminum cylinder having a diameter of 80 mm and a length of 360 mm by dip coating and then dried thereby to form a 0.5 micron-thick primer layer.

Next, 10 parts (parts by weight, the same in the description appearing hereinafter) of a trisazo pigment as a charge-generating material represented by the following structural formula, and 6 parts of a polyvinyl butyral resin (S-LEC BL-S, mfd. by Sekisui Kagaku K.K.)

were dispersed in 50 parts of cyclohexanone by means of a sand mill using glass beads.

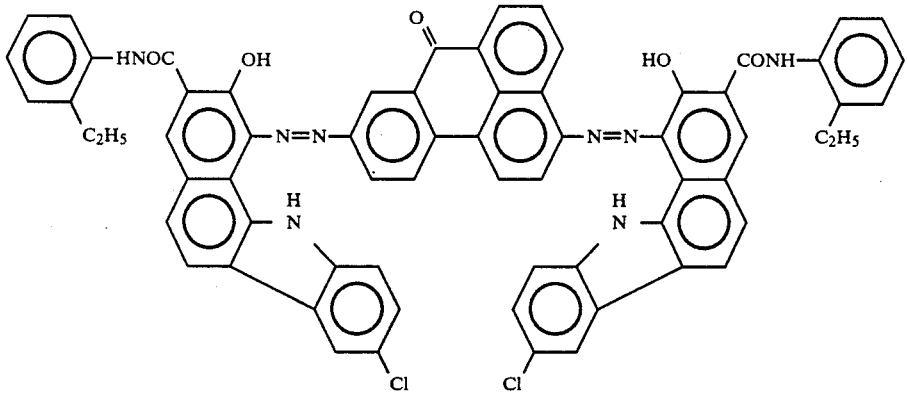

To the resultant dispersion, 100 parts methyl ethyl ketone of was added, and then the dispersion was applied onto the primer layer and dried thereby to form a 0.2 micron-thick charge generation layer.

Then, 10 parts of a stilbene compound represented by the following structural formula, and 10 parts of a polycarbonate resin (Panlite L-1250, mfd. by Teijin Kasei K.K.) were dissolved in 50 parts of dichloromethane and 10 parts of monochlorobenzene, thereby to prepare a coating liquid for a charge transport layer.

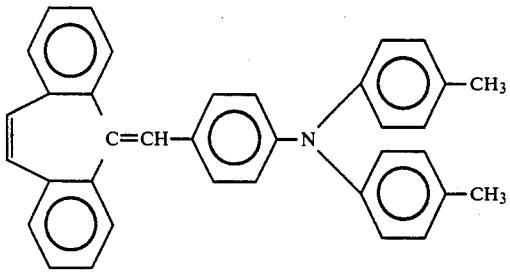

To the resultant coating liquid, 1,3,5-trimethyl-2,4,6-tris(3,5,-di-t-butyl-4-hydroxybenzyl) benzene (THBZ-1) represented by the following structural formula (trade name: Irganox 1330, mfd. by Nihon Ciba-Geigy K.K.):

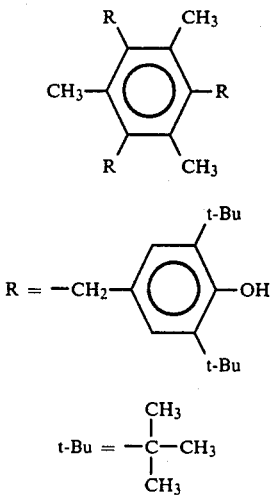

and tris(2,4-di-t-butylphenyl) phosphite (TBP-1) represented by the following formula (trade name: Irgafos 168, mfd. by Nihon Ciba-Geigy K.K.):

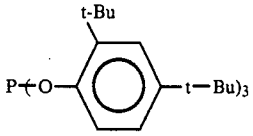

distearyl-3,3'-thiodipropionate (TP-1):

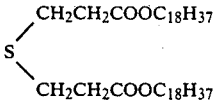

(Sumilizer TPS: mfd. by Sumitomo Kagaku Kogyo K.K.) and 1,3-di-4-pyridylpropane (DPy-1):

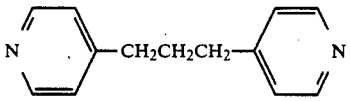

were added in various addition amounts as shown in Table 9 appearing hereinafter, thereby to prepare six species of coating liquids. More specifically, the total addition amount was 0.4 part or 2 parts, and the mixing ratio was 1:1:1:0.1, 1:1:1:0.05, and 1:1:1:0.2 with respect to the respective addition amounts.

Each of the thus prepared six species of coating liquids was applied onto the above-mentioned charge generation layer to form a 18 micron-thick charge transport layer, whereby six species of photosensitive member Nos. 54 to 59 as shown in Table 9 were obtained.

Further, five species of photosensitive member Nos. 60–64 as comparative samples as shown in Table 9 were prepared in the same manner as described above except those as described below. More specifically, the photosensitive member No. 60 was prepared by using no additive, the photosensitive member Nos. 61 and 62 were prepared by adding THBZ-1, TBP-1, and TP-1 at a mixing ratio of 1:1:1 in total addition amounts of 0.4 part and 2 parts, respectively, and the photosensitive member Nos. 63 and 64 were prepared by adding DPy-1 alone in amounts of 0.4 part and 2 parts, respectively.

Each of the thus prepared photosensitive member Nos. 54–64 was assembled in an electrophotographic copying machine (trade name: CLC 1, mfd. by Canon K.K.) and the characteristics thereof were evaluated in the following manner.

Thus, a latent image was formed on the photosensitive member under a condition such that the dark part potential ($V_D$) of the photosensitive member was −650 V and the light part potential ($V_L$) thereof was −150 V. The light quantity (lux.sec) for image exposure providing such a latent image was measured and defined as "initial sensitivity". Then, after successive copying of 5,000 sheets, the above-mentioned potentials $V_D$ and $V_L$ were measured and the decrease rate (%) in $V_D$ and increase (V) in $V_L$ on the basis of the above-mentioned initial values were determined.

Thereafter, the photosensitive member was left standing in the copying machine for 10 hours, and the surface potential of the photosensitive member was measured. At this time, a portion of the photosensitive member disposed under a corona charger was marked and the difference in $V_D$ ($\Delta V_D$) between this portion and the other portion was determined.

Further, successive copying of 5,000 sheets (10,000 sheets in total) was conducted and then the photosensitive member was left standing in the copying machine for one week. Thereafter, the above-mentioned measurement of surface potential was conducted in the same manner as in the case of the successive copying of 5,000 sheets. In this case, $\Delta V_D$ was measured so that the portion of the photosensitive member disposed under the corona charger was the same as that used in the case of the successive copying of 5,000 sheets. The thus obtained results are shown in the following Table 9.

TABLE 9

| Photo-sensitive member | Addition amount (%) | Mixing ratio | Initial sensi-tivity (lux · sec) | Decrease rate in $V_D$ (%) (5000 sheets) | Increase in $V_L$ (V) (5000 sheets) | $\Delta V_D$ (V) after standing for 10 hours (5000 sheets) | $\Delta V_D$ (V) after standing for 1 week (10000 sheets) |
|---|---|---|---|---|---|---|---|
| 54 | 2 | 1/1/1/0.1 | 3.2 | 1.0 | 25 | 0* | 15 |
| 55 | 10 | 1/1/1/0.1 | 3.5 | 1.0 | 25 | 0* | 10 |
| 56 | 2 | 1/1/1/0.05 | 3.2 | 1.0 | 25 | 0* | 20 |
| 57 | 10 | 1/1/1/0.05 | 3.6 | 1.0 | 25 | 0* | 15 |
| 58 | 2 | 1/1/1/0.2 | 3.3 | 1.0 | 30 | 0* | 15 |
| 59 | 10 | 1/1/1/0.2 | 3.6 | 1.0 | 30 | 0* | 10 |
| 60 | 0 | — | 3.0 | 33.5 | 10 | 80 | 140 |
| 61 | 2 | 1/1/1/0 | 3.1 | 2.0 | 20 | 5 | 45 |
| 62 | 10 | 1/1/1/0 | 3.4 | 1.0 | 25 | 0* | 35 |
| 63 | 0.2 | 0/0/0/1 | 3.2 | 2.0 | 25 | 10 | 40 |
| 64 | 1.0 | 0/0/0/1 | 3.3 | 2.0 | 25 | 5 | 35 |

*: Substantially none

As apparent from the above Table 9, in the photosensitive members according to the present invention wherein the photosensitive layer contains specific four species of additives, the decrease in the dark part potential is small and the effect on the prevention of deterioration is excellent, in a repeated electrophotographic process. Particularly, the deterioration in a photosensitive member portion disposed under a corona charger is very little, even after long-term standing. Further, ill effect on the electrophotographic characteristic such as an increase in the light part potential is substantially none.

On the contrary, in the photosensitive members not containing the above-mentioned additive, the dark park potential is considerably decreased due to deterioration, and the photosensitive member portion disposed under the corona charger is also considerably deteriorated, in a successive electrophotographic process.

EXAMPLE 9

A primer layer was formed on an electroconductive substrate by coating in the same manner as in Example 8.

Separately, 10 parts of a disazo pigment as a charge-generating material represented by the following structural formula, and 6 parts of a polyvinyl butyral resin (S-LEC BX-1, mfd. by Sekisui Kagaku K.K.) were dispersed in 50 parts of cyclohexanone by means of a sand mill using glass beads.

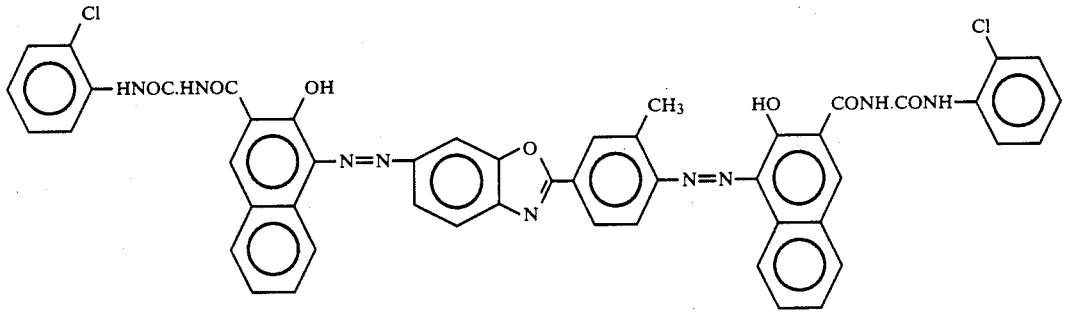

To the resultant dispersion, 100 parts of tetrahydrofuran was added, and then the dispersion was applied onto the primer layer and dried thereby to form a 0.2 micron-thick charge generation layer.

Then, 8 parts of a benzocarbazole compound as a charge-transporting material represented by the following structural formula, and 10 parts of a styrene-acrylic copolymer resin (Estyrene MS-200, mfd. by Shin-Nihon Seitetsu Kagaku K.K.);

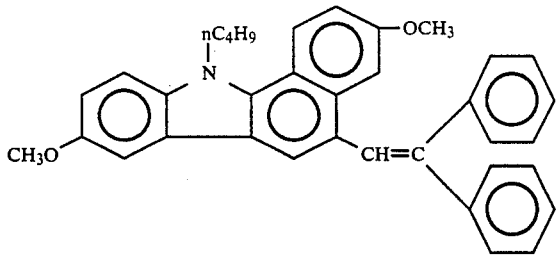

and four species of additives including 1,3,5-trimethyl-2,4,6-tris(3,5-di-t-amyl-5-hydroxybenzyl) benzene (THBZ-2):

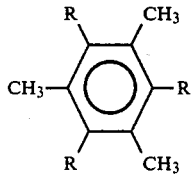

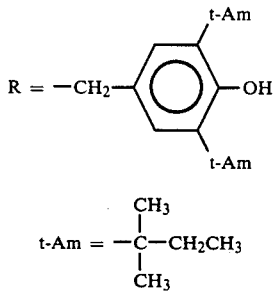

tris(2,4-di-t-amylphenyl)phosphite (TBP-2)

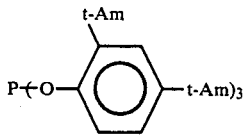

dimyristyl-3,3'-thiodipropionate (TP-2):

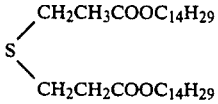

(Sumilizer TPM: mfd. by Sumitomo Kagaku Kogyo K.K.) and 4,4'-bipyridyl (DPy-2):

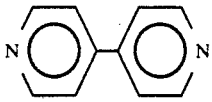

(total amount of additives=0.72 part, mixing ratio=1:1:1:0.3) were dissolved in 15 parts of dichloromethane and 45 parts of monochlorobenzene, thereby to prepare a coating liquid for a charge transport layer. The thus prepared coating liquid was then applied onto the above-mentioned charge generation layer to form a 18 micron-thick charge generation layer, whereby a photosensitive member No. 65 was prepared.

Further, photosensitive member Nos. 66 and 67 were prepared in the same manner as described above except for using these additives at mixing ratios of 1:0.5:0.5:0.1, and 1:2:2:1.

On the other hand, a comparative photosensitive member No. 68 was prepared in the same manner as described above except for using none of these four species of additives.

The thus prepared photosensitive member Nos. 65–68 were evaluated in the same manner as in Example 8. The results are shown in the following Table 10.

TABLE 10

| Photo-sensitive member | Addition amount (%) | Mixing ratio | Initial sensi-tivity (lux · sec) | Decrease rate in $V_D$ (%) (5000 sheets) | Increase in $V_L$ (V) (5000 sheets) | $\Delta V_D$ (V) after standing for 10 hours (5000 sheets) | $\Delta V_D$ (V) after standing for 1 week (10000 sheets) |
|---|---|---|---|---|---|---|---|
| 65 | 4 | 1/1/1/0.3 | 3.2 | 1.2 | 25 | 0* | 10 |
| 66 | 4 | 1/0.5/0.5/0.1 | 3.1 | 1.3 | 25 | 0* | 10 |
| 67 | 4 | 1/2/2/1 | 3.3 | 1.0 | 30 | 0* | 5 |
| 68 | — | — | 2.8 | 32.0 | 15 | 100 | 150 |

*: Substantially none

As shown in the above Table 10, the photosensitive member containing specific four species of additives according to the present invention provides a small change in the potential and is excellent in prevention of deterioration. Example 10

A primer layer was formed on an electroconductive substrate by coating in the same manner as in Example 8.

Separately, 15 parts of a stilbene compound represented by the following structural formula, and 10 parts of a polycarbonate resin (Panlite L-1250, mfd. by Teijin Kasei K.K.) were dissolved in 50 parts of dichloromethane and 10 parts of monochlorobenzene, thereby to prepare a coating liquid for a charge transport layer. The thus prepared coating liquid was applied onto the primer layer to form a 15 micron-thick charge transport layer.

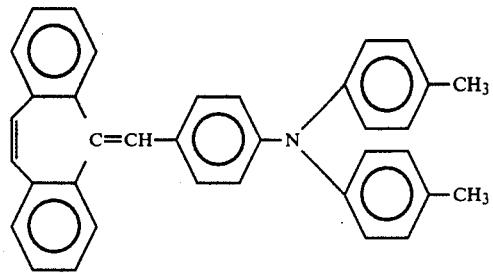

Then, 4 parts of a disazo pigment represented by the following structural formula:

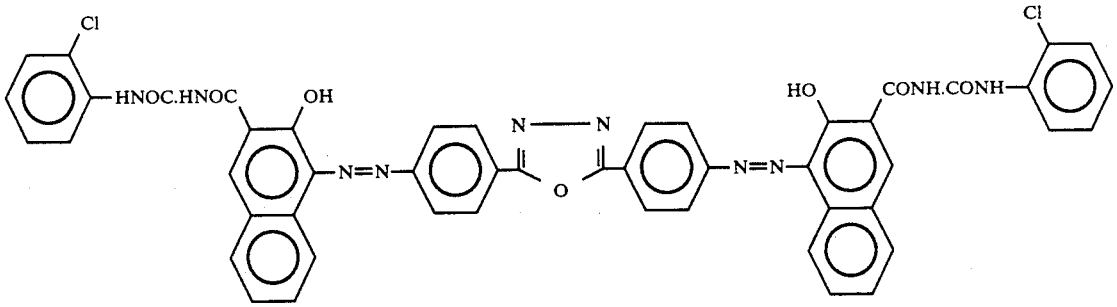

7 parts of the above-mentioned stilbene compound, 10 parts of the above-mentioned polycarbonate resin; and THBZ-1, TBP-1, TP-1 and DPy-1 (total amount of additives=0.63 part, mixing ratio=1:1:1:0.2) were dissolved or dispersed in 150 parts of dichloromethane and 50 parts of monochlorobenzene to prepare a coating liquid.

The thus prepared coating liquid was then applied onto the above-mentioned charge transport layer by spraying to form a 5 micron-thick charge generation layer, whereby a photosensitive member No. 69 was prepared.

On the other hand, a comparative photosensitive member No. 70 was prepared in the same manner as described above except for using none of these four species of additives.

The thus prepared photosensitive members were evaluated in the same manner as described above except that evaluation conditions were set so that $V_D=+650$ V and $V_L=+150$ V were provided under positive charging. The results are shown in Table 11 appearing hereinafter.

EXAMPLE 11

A primer layer was formed on an electroconductive substrate by coating in the same manner as in Example 8.

Separately, 1 parts of a disazo pigment represented on the following structural formula:

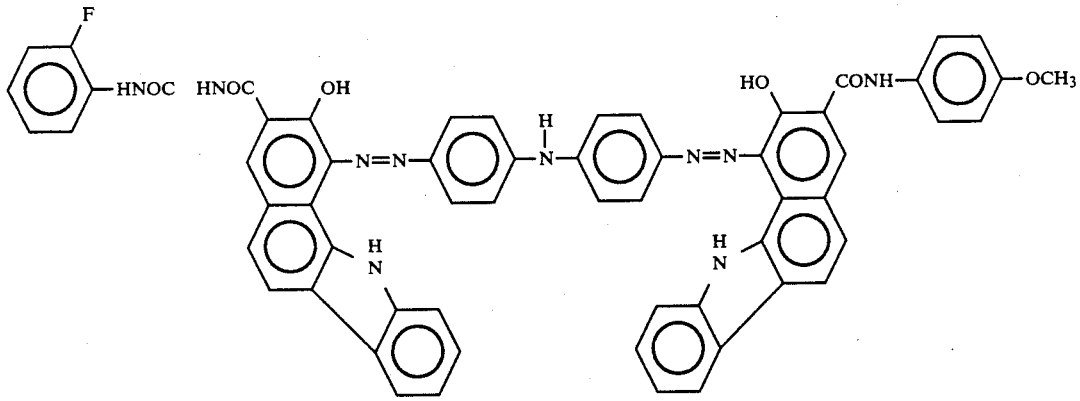

10 parts of the benzocarbazole compound used in Example 9, 10 parts of a polycarbonate resin (Panlite L-1250, mfd. by Teijin Kasei K.K.); and four species of additive including 1,3,5-trimethyl-2,4,6-tris(3-t-amyl-5-t-butyl-4-hydroxybenzyl)benzene (THBZ-3):

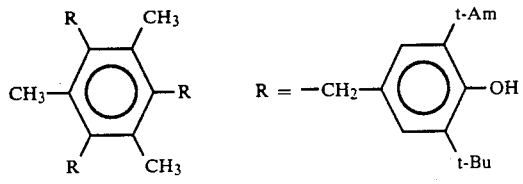

tris (2-t-amyl-4-t-butylphenyl)phosphite (TBP-3):

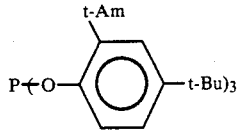

lauryl-stearyl-3,3'-thiodipropionate (TP-3):

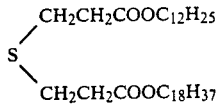

(Cyarox 1212: mfd. by ACC)

and 1,2-di(2-pyridyl)ethane (DPy-3):

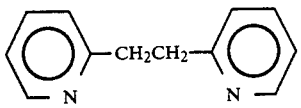

(total amount of additives=0.42 part, mixing ratio=1:1:1:0.1) were dissolved or dispersed in 60 parts of dichloromethane and 20 parts of monochlorobenzene, thereby to prepare a coating liquid. The thus prepared coating liquid was then applied onto the above-mentioned primer layer to form a 16 micron-thick photosensitive layer, whereby a photosensitive member No. 71 was prepared.

On the other hand, a comparative photosensitive member No. 72 was prepared in the same manner as described above except for using none of these four species of additives.

The thus prepared photosensitive members were evaluated in the same manner as in Example 10. The results are shown in the following Table 11.

TABLE 11

| Photo-sensitive member | Addition amount (%) | Mixing ratio | Decrease rate in $V_D$ (%) (5000 sheets) | Increase in $V_L$ (V) (5000 sheets) | $\Delta V_D$ after standing for 10 hours (5000 sheets) | $\Delta V_D$ (V) after standing for 1 week (10000 sheets) |
|---|---|---|---|---|---|---|
| 69 | 3 | 1/1/1/0.2 | 1.2 | 20 | 0* | 15 |
| 70 | — | — | 35.8 | 10 | 120 | 150 |
| 71 | 2 | 1/1/1/0.1 | 1.3 | 25 | 0* | 15 |
| 72 | — | — | 29.1 | 20 | 100 | 130 |

*: Substantially none

EXAMPLE 12

Photosensitive member Nos. 73–77 were prepared in the same manner as in Example 8 except for using additives used in Example 8 and those as shown in the following Table 12 in a mixture (mixing ratio = 1:1:1:0.1, total addition amount = 10 %). The results are shown in Table 13 appearing hereinafter.

TABLE 12

| Abbreviation | Additive |
|---|---|
| DPy-4 | 1,2-di-4-pyridylethylene 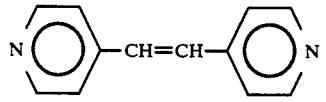 |
| DPy-5 | di-2-pyridylsulfide 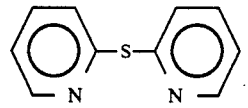 |
| DPy-6 | di-2-pyridyldisulfide 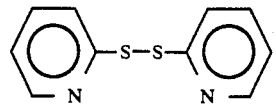 |
| DPy-6 | 5-methyl-2(5'-ethyl-2'-pyridyl)pyridine 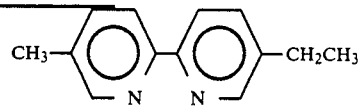 |
| DPy-7 | 5-isopropyl-2(2'-butenyl-4'-pyridyl)pyridine 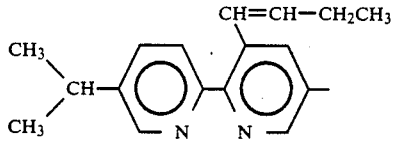 |

TABLE 13

| Photo-sensitive member | Addition amount (%) | Mixture additive | Initial sensi-tivity (lux · sec) | Decrease rate in $V_D$ (%) (5000 sheets) | Increase in $V_L$ (V) (5000 sheets) | $\Delta V_D$ (V) after standing for 10 hours (5000 sheets) | $\Delta V_D$ (V) after standing for 1 week (10000 sheets) |
|---|---|---|---|---|---|---|---|
| 73 | 10 | THBZ-1/TBP-1/TP-1/DPy-4 | 3.5 | 1.5 | 25 | 0* | 15 |
| 74 | 10 | THBZ-1/TBP-1/TP-1/DPy-5 | 3.6 | 1.2 | 25 | 0* | 15 |
| 75 | 10 | THBZ-1/TBP-1/TP-1/DPy-5 | 3.4 | 1.3 | 20 | 0* | 10 |
| 76 | 10 | THBZ-1/TBP-1/TP-1/DPy-6 | 3.5 | 1.1 | 20 | 0* | 15 |
| 77 | 10 | THBZ-1/TBP-1/TP-1/DPy-7 | 3.7 | 1.4 | 25 | 0* | 10 |

*: Substantially none

EXAMPLE 13

The photosensitive member Nos. 55, 60 and 65 prepared in Examples 8 and 9, and the photosensitive member No. 77 prepared in Example 12, were further subjected to 40,000 sheets of copying in addition to the 10,000 sheets of copying conducted in the above-mentioned evaluation.

As a result, with respect to the photosensitive member Nos. 55, 65 and 77, even after the above-mentioned 50,000 sheets of copying, there was substantially no decrease in image quality as compared with the initial stage, and there were obtained images stably retaining a high contrast and being free of unevenness. On the other hand, with respect to the photosensitive member No. 60, the image density was remarkably decreased at the time of about 15,000 sheets of successive copying. Further, in the photosensitive member No. 60, only images with considerable unevenness were obtained due to potential decrease which was caused in downtime after completion of copying.

What is claimed is:

1. A photosensitive member for electrophotography comprising: an electroconductive substrate, and a photosensitive layer disposed thereon comprising an organic photoconductor; said photosensitive layer containing, at least, a compound represented by the following formula (I):

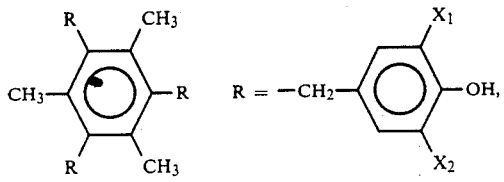

(I)

wherein $X_1$ denotes

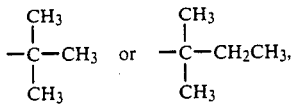

and $X_2$ denotes a hydrogen atom, an alkyl group having 1–10 carbon atoms or an alkenyl group having 2–10 carbon atoms; and a compound represented by the following formula (II):

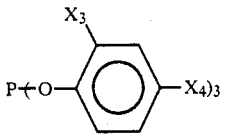

(II)

wherein $X_3$ and $X_4$ respectively denote an alkyl group having 1–10 carbon atoms or an alkenyl group having 2–10 carbon atoms.

2. A photosensitive member according to claim 1, wherein $X_2$ in the formula (I) is an alkyl group having 1–5 carbon atoms or an alkenyl group having 2–5 carbon atoms, and $X_3$ and $X_4$ in the formula (II) are respectively an alkyl group having 1–5 carbon atoms or an alkenyl group having 2–5 carbon atoms.

3. A photosensitive member according to claim 1, wherein the compound represented by the formula (I) is selected from the group consisting of: 1,3,5-trimethyl-2,4,6-tris(3,5-di-t-butyl-4-hydroxybenzyl)benzene, 1,3,5-trimethyl-2,4,6-tris(3,5-di-t-amyl-4-hydroxybenzyl)benzene, 1,3,5-trimethyl-2,4,6-tris(3-t-butyl-5-methyl-4-hydroxybenzyl)benzene, 1,3,5-trimethyl-2,4,6-tris(3-t-amyl-5-isopropyl-4hydroxybenzyl)benzene, and 1,3,5-trimethyl-2,4,6tris(3-t-amyl-5-(1-butenyl)-4-hydroxybenzyl)benzene; and the compound represented by the formula (II) is selected from the group consisting of: tris(2,4-di-t-butylphenyl)phosphite, tris(2,4-di-t-amylphenyl)-phosphite, tris(2-t-butyl-4-methylphenyl)phosphite, tris(2-ethyl-4-methylphenyl)-phosphite, and tris(2-t-amyl-4-(1-butenyl)phenyl)-phosphite.

4. A photosensitive member according to claim 1, wherein $X_2$ in the formula (I) is

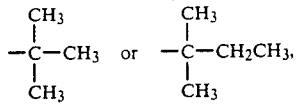

and $X_3$ and $X_4$ are respectively

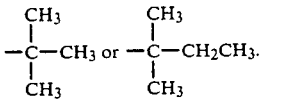

5. A photosensitive member according to claim 1, wherein the total amount of the compounds (I) and (II) contained in the photosensitive layer is 0.5–20 wt. % based on the total weight of the photosensitive layer (not including the weight of the compound (I) or (II)).

6. A photosensitive member according to claim 5, wherein the total amount of the compounds (I) and (II) contained in the photosensitive layer is 2–15 wt. % based on the total weight of the photosensitive layer (not including the weight of the compound (I) or (II)).

7. A photosensitive member according to claim 1, wherein the mixing wt. ratio between the compounds (I) and (II) contained in the photosensitive layer is 0.1:1 to 1:0.1.

8. A photosensitive member according to claim 7, wherein the mixing wt. ratio between the compounds (I) and (II) contained in the photosensitive layer is 0.3:1 to 1:0.3.

9. A photosensitive member according to claim 1, wherein the photosensitive layer comprises a single layer.

10. A photosensitive member according to claim 1, wherein the photosensitive layer has a laminate structure comprising a charge generation layer and a charge transport layer.

11. A photosensitive member according to claim 10, wherein the charge transport layer is disposed on the charge generation layer, and said compounds (I) and (II) are contained in the charge transport layer.

12. A photosensitive member according to claim 10, wherein the charge generation layer is disposed on the charge transport layer, and said compounds (I) and (II) are contained in the charge generation layer.

13. A photosensitive member according to claim 1, wherein the photosensitive layer contains a lubricant.

14. A photosensitive member according to claim 1, which further comprises an intermediate layer disposed between the electroconductive substrate and the photosensitive layer.

15. A photosensitive member for electrophotography comprising: an electroconductive substrate, and a photosensitive layer disposed thereon comprising an organic photoconductor; said photosensitive layer containing, at least, a compound represented by the following formula (I):

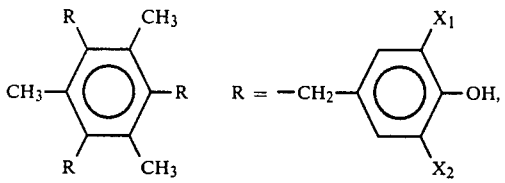

(I)

wherein $X_1$ denotes

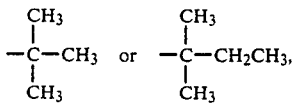

and $X_2$ denotes a hydrogen atom, an alkyl group having 1–10 carbon atoms or an alkenyl group having 2–10 carbon atoms;

a compound represented by the following formula (II):

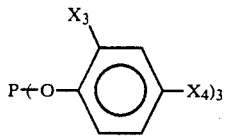

(II)

wherein $X_3$ and $X_4$ respectively denote an alkyl group having 1–10 carbon atoms or an alkenyl group having 2–10 carbon atoms; and a compound represented by the following formula (III):

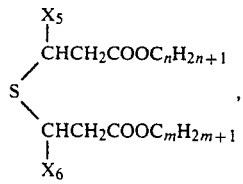

(III)

wherein n and m respectively denote an integer of 10–20, and $X_5$ and $X_6$ respectively denote a hydrogen atom or an alkyl group having 1–10 carbon atoms.

16. A photosensitive member according to claim 16, wherein $X_2$ in the formula (I) is an alkyl group having 1–5 carbon atoms or an alkenyl group having 2–5 carbon atoms; $X_3$ and $X_4$ in the formula (II) are respectively an alkyl group having 1–5 carbon atoms or an alkenyl group having 2–5 carbon atoms; and $X_5$ and $X_6$ in the formula (III) are respectively a hydrogen atom or an alkyl group having 1–4 carbon atoms, and n and m are respectively an integer of 12–18.

17. A photosensitive member according to claim 15, wherein the compound represented by the formula (I) is selected from the group consisting of: 1,3,5-trimethyl2,4,6-tris(3,5-di-t-butyl-4-hydroxybenzyl)benzene, 1,3,5-trimethyl-2,4,6-tris(3,5-di-t-amyl-4-hydroxybenzyl)benzene, 1,3,5-trimethyl-2,4,6-tris(3-t-butyl-5-methyl-4-hydroxybenzyl)benzene, 1,3,5-trimethyl-2,4,6-tris(3-t-amyl-5-isopropyl-4hydroxybenzyl)benzene, and 1,3,5-trimethyl-2,4,6tris(3-t-amyl-5-(1-butenyl)-4-hydroxybenzyl)benzene;

the compound represented by the formula (II) is selected from the group consisting of: tris(2,4-di-t-butylphenyl)phosphite, tris(2,4-di-t-amylphenyl)-phosphite, tris(2-t-butyl-4-methylphenyl)phosphite, tris(2-ethyl-4-methylphenyl)phosphite, and tris(2-t-amyl-4-1-butenyl)phenyl)phosphite; and the compound represented by the formula (III) is selected from the group consisting of: dilauryl-3,3'-thiodipropionate, ditridecyl-3,3'-thiodipropionate, dimyristyl-3,3'-thiodipropionate, lauryl-stearyl-3,3'-thiodipropionate, distearyl-3,3'-thiodipropionate, distearyl-3,3'-methyl-3,3'-thiodipropionate, and distearyl-3,ethyl-3'-methyl-3,3'-thiodipropionate.

18. A photosensitive member according to claim 15, wherein $X_2$ in the formula (I) is

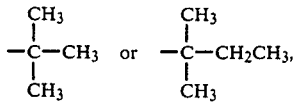

$X_3$ and $X_4$ in the formula (II) are respectively

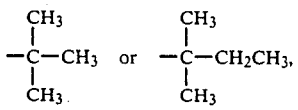

and $X_5$ and $X_6$ in the formula (III) are respectively a hydrogen atom, and n and m are respectively an integer of 12, 14 or 18.

19. A photosensitive member according to claim 15, wherein the total amount of the compounds (I), (II) and (III) contained in the photosensitive layer is 0.5–20 wt. % based on the total weight of the photosensitive layer (not including the weight of the compound (I), (II) or (III)).

20. A photosensitive member according to claim 15, wherein the total amount of the compounds (I), (II) and (III) contained in the photosensitive layer is 2–15 wt. % based on the total weight of the photosensitive layer (not including the weight of the compound (I), (II) or (III)).

21. A photosensitive member according to claim 15, wherein the mixing wt. ratio among the compounds (I), (II) and (III) contained in the photosensitive layer is 1:(0.2 to 5):(0.2 to 5).

22. A photosensitive member according to claim 21, wherein the mixing wt. ratio among the compounds (I), (II) and (III) contained in the photosensitive layer is 1:(0.5 to 2):(0.5 to 2).

23. A photosensitive member according to claim 15, wherein the photosensitive layer comprises a single layer.

24. A photosensitive member according to claim 15, wherein the photosensitive layer has a laminate structure comprising a charge generation layer and a charge transport layer.

25. A photosensitive member according to claim 24, wherein the charge transport layer is disposed on the charge generation layer, and said compounds (I), (II) and (III) are contained in the charge transport layer.

26. A photosensitive member according to claim 24, wherein the charge generation layer is disposed on the charge transport layer, and said compounds (I), (II) and (III) are contained in the charge generation layer.

27. A photosensitive member according to claim 15, wherein the photosensitive layer contains a lubricant.

28. A photosensitive member according to claim 15, which further comprises an intermediate layer disposed between the electroconductive substrate and the photosensitive layer.

29. A photosensitive member for electrophotography comprising: an electroconductive substrate, and a photosensitive layer disposed thereon comprising an organic photoconductor; said photosensitive layer containing, at least, a compound represented by the following formula (I):

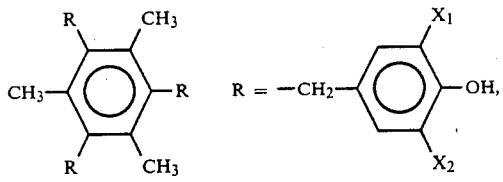

(I)

wherein $X_1$ denotes

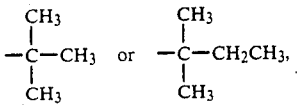

and $X_2$ denotes a hydrogen atom, an alkyl group having 1–10 carbon atoms or an alkenyl group having 2–10 carbon atoms;

a compound represented by the following formula (II):

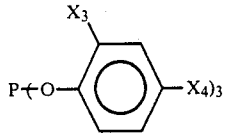

(II)

wherein $X_3$ and $X_4$ respectively denote an alkyl group having 1–10 carbon atoms or an alkenyl group having 2–10 carbon atoms;

a compound represented by the following formula (III):

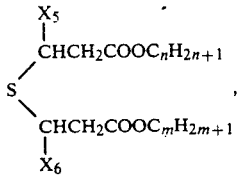

(III)

wherein n and m respectively denote an integer of 10–20, and $X_5$ and $X_6$ respectively denote a hydrogen atom or an alkyl group having 1–10 carbon atoms; and a compound represented by the following formula (IV):

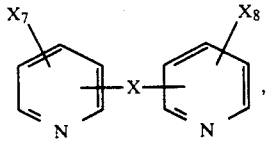

(IV)

wherein X denotes —S—, —S—S—, or $-(CH_2)_l$ or $-(CH=CH)_p-$, wherein l denotes an integer of 0–10, and p denotes an integer of 1–5, and $X_7$ and $X_8$ respectively denote a hydrogen atom, an alkyl group having 1–10 carbon atoms or an alkenyl group having 2–10 carbon atoms.

30. A photosensitive member according to claim 29, wherein $X_2$ in the formula (I) is an alkyl group having 1–5 carbon atoms or an alkenyl group having 2–5 carbon atoms, and $X_3$ and $X_4$ in the formula (II) are respectively an alkyl group having 1–5 carbon atoms or an alkenyl group having 2–5 carbon atoms; $X_5$ and $X_6$ in the formula (III) are respectively a hydrogen atom or an alkyl group having 1–4 carbon atoms, and n and m are respectively an integer of 12–18; and $X_7$ and $X_8$ in the formula (IV) are respectively a hydrogen atom, an alkyl group having 1–4 carbon atoms or an alkenyl group having 2–4 carbon atoms, l is an integer of 0–4, and p is an integer of 1–3.

31. A photosensitive member according to claim 29, wherein the compound represented by the formula (I) is selected from the group consisting of: 1,3,5-trimethyl-2,4,6-tris(3,5-di-t-butyl-4-hydroxybenzyl)benzene, 1,3,5-trimethyl-2,4,6-tris(3,5-di-t-amyl-4-hydroxybenzyl)benzene, 1,3,5-trimethyl-2,4,6-tris(3-t-butyl-5-methyl-4-hydroxybenzyl)benzene, 1,3,5-trimethyl-2,4,6-tris(3-t-amyl-5-isopropyl-4hydroxybenzyl)benzene, and 1,3,5-trimethyl-2,4,6tris(3-t-amyl-5-(1-butenyl)-4-hydroxybenzyl)benzene;

the compound represented by the formula (II) is selected from the group consisting of: tris(2,4-di-t-butylphenyl)phosphite, tris(2,4-di-t-amylphenyl)-phosphite, tris(2-t-butyl-4-methylphenyl)phosphite, tris(2-ethyl-4-methylphenyl)phosphite, and tris(2-t-amyl-4-(1-butenyl)phenyl)phosphite;

the compound represented by the formula (III) is selected from the group consisting of: dilauryl-3,3'-thio-dipropionate, ditridecyl-3,3'-thiodipropionate, dimyristyl-3,3'-thiodipropionate, lauryl-stearyl-3,3'-thiodipropionate, distearyl-3,3'-thiodipropionate, distearyl-3,3'-methyl-3,3'-thiodipropionate, and distearyl-3-ethyl-3'-methyl-3,3'-thiodipropionate; and the compound represented by the formula (IV) is selected from the group consisting of: 2,2'-bipyridyl, 4,4'-bipyridyl, 1,2-di(2-pyridyl)ethane, 1,3-di-4-pyridylpropane, di-2-pyridylsulfide, di-2-pyridyldisulfide, 1,2-di-4-pyridylethylene, 5-t-butyl-2(3'-ethyl-2'-pyridyl)pyridine, 5-methyl-2(5'-ethyl-2'-pyridyl)pyridine, and 5-isopropyl-2(2'-butenyl-4'-pyridyl)pyridine.

32. A photosensitive member according to claim 29, wherein $X_2$ in the formula (I) is

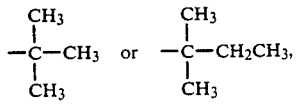

$X_3$ and $X_4$ are respectively

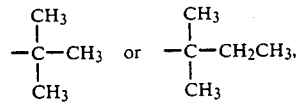

$X_5$ and $X_6$ in the formula (III) are respectively a hydrogen atom, and n and m are respectively an integer of 12, 14 or 18; and X in the formula (IV) is $-(CH_2)_l-$ wherein l is an integer of 0–3, and $X_7$ and $X_8$ are respectively a hydrogen atom.

33. A photosensitive member according to claim 29, wherein the total amount of the compounds (I), (II), (III) and (IV) contained in the photosensitive layer is 0.5–20 wt. % based on the total weight of the photosensitive layer (not including the weight of the compound (I), (II), (III) or (IV)).

34. A photosensitive member according to claim 33, wherein the total amount of the compounds (I), (II), (III) and (IV) contained in the photosensitive layer is 2–15 wt. % based on the total weight of the photosensitive layer (not including the weight of the compound (I), (II), (III) or (IV)).

35. A photosensitive member according to claim 29, wherein the mixing wt. ratio among the compounds (I), (II), (III) and (IV) contained in the photosensitive layer is 1:(0.2 to 5):(0.2 to 5):(0.05 to 2).

36. A photosensitive member according to claim 35, wherein the mixing wt. ratio among the compounds (I), (II), (III) and (IV) contained in the photosensitive layer is 1:(0.5 to 2):(0.5 to 2):(0.1 to 2).

37. A photosensitive member according to claim 29, wherein the photosensitive layer comprises a single layer.

38. A photosensitive member according to claim 29, wherein the photosensitive layer has a laminate structure comprising a charge generation layer and a charge transport layer.

39. A photosensitive member according to claim 38, wherein the charge transport layer is disposed on the charge generation layer, and said compounds (I), (II), (III) and (IV) are contained in the charge transport layer.

40. A photosensitive member according to claim 38, wherein the charge generation layer is disposed on the charge transport layer, and said compounds (I), (II), (III) and (IV) are contained in the charge generation layer.

41. A photosensitive member according to claim 29, wherein the photosensitive layer contains a lubricant.

42. A photosensitive member according to claim 29, which further comprises an intermediate layer disposed between the electroconductive substrate and the photosensitive layer.

* * * * *

UNITED STATES PATENT AND TRADEMARK OFFICE

CERTIFICATE OF CORRECTION

PATENT NO. : 5,008,168

DATED : April 16, 1991

INVENTOR(S) : MASARU NAKAGAWA, ET AL

It is certified that error appears in the above-indentified patent and that said Letters Patent is hereby corrected as shown below:

IN [57] ABSTRACT

Line 4, "the" should read --The--.
Line 5, "least," should read --least--.

COLUMN 1

Line 27, "and" should read --and such that--.
Line 53, "factors" should read --the factors--.

COLUMN 2

Line 13, "additive" should read --additives--.

COLUMN 5

Line 1, "DRAWING" should read --DRAWINGS--.
Line 21, "hydroperoxidedecomposing" should read --hydroperoxide-decomposing--.
Line 33, "trimethyl2," should read --trimethyl-2,--.
Line 38, "4hydroxybenzyl)" should read --4-hydroxybenzyl)--.
Line 42, "atoms" (second occurrence) should read --atoms,--.

COLUMN 6

Line 1, "erably" should read --erably,--.
Line 10, "effect" should read --effects--.
Line 11, "is" should read --are--.
Line 17, "effect" should read --effects--.

UNITED STATES PATENT AND TRADEMARK OFFICE

CERTIFICATE OF CORRECTION

PATENT NO. : 5,008,168

DATED : April 16, 1991

INVENTOR(S) : MASARU NAKAGAWA, ET AL

It is certified that error appears in the above-indentified patent and that said Letters Patent is hereby corrected as shown below:

COLUMN 6

Line 22, "methyl3," should read --methyl-3,--.
Line 33, "a" should read --the--.
Line 46, "effect" should read --effects--.
Line 59, "conona" should read --corona--.
Line 66, "4pyridylpro-" should read --4-pyridylpro- --.

COLUMN 7

Line 7, "x" should read --X--.
Line 12, "erably" should read --erably,-- and "a" should read --the--.
Line 22, "effect" should read --effects--.

COLUMN 8

Line 1, "and" should be deleted.
Line 4, "and" should be deleted.
Line 11, "to form" should read --forming--.
Line 68, "apparatus" should read --apparatuses--.

COLUMN 9

Line 65, "(Panlite" should read --(trade name: Panlite--.

COLUMN 11

Line 16, "a" should read --an--.

UNITED STATES PATENT AND TRADEMARK OFFICE

CERTIFICATE OF CORRECTION

PATENT NO. : 5,008,168

DATED : April 16, 1991

INVENTOR(S) : MASARU NAKAGAWA, ET AL

It is certified that error appears in the above-indentified patent and that said Letters Patent is hereby corrected as shown below:

COLUMN 12

Line 61, "As" should read --As is--.
Lines 63-64, "specific two" should read --two specific--.

COLUMN 13

Line 1, "ill" should read --deleterious--.
Line 23, "(S-LEC BX-1, mfd." should read --(trade name: S-LEC BX-1, made--.
Line 49, "to form" should read --forming--.
Line 53, "(Estyrene MS-200," should read --(trade name: Estyrene MS-200,--.
Line 54, "mfd." should read --made--.

COLUMN 14

Line 43, "a" should read --an--.

COLUMN 15

TABLE 3-continued, "Antioxidant," should read --(Antioxidant,--.

COLUMN 16

Line 27, "The" should read --the--.
Line 55, "ill" should read --deleterious--.

UNITED STATES PATENT AND TRADEMARK OFFICE

CERTIFICATE OF CORRECTION

PATENT NO. : 5,008,168

DATED : April 16, 1991

INVENTOR(S) : MASARU NAKAGAWA, ET AL

It is certified that error appears in the above-indentified patent and that said Letters Patent is hereby corrected as shown below:

COLUMN 17

Line 13, "HNOC HNOC" should read --HNOC.HNOC--.
Line 64, "1.1" should read --1.--.
Line 68, "$V_D$=650 V" should read $V_D$=+650 V--.

COLUMN 19

Line 2, "to form" should read --forming--.

COLUMN 21

Line 26, "4hydroxybenzyl)" should read --4-hydroxybenzyl)--.

COLUMN 22

Line 37, "No." should read --Nos.--.
Line 63, "to form" should read --forming--.

COLUMN 25

Line 65, "As" should read --As is--.

COLUMN 26

Line 5, "ill" should read --deleterious--.

UNITED STATES PATENT AND TRADEMARK OFFICE

CERTIFICATE OF CORRECTION

PATENT NO. : 5,008,168

DATED : April 16, 1991

INVENTOR(S) : MASARU NAKAGAWA, ET AL

It is certified that error appears in the above-indentified patent and that said Letters Patent is hereby corrected as shown below:

COLUMN 28

Line 12, "to form" should read --forming--.
Line 41, "Example 10" should be a centered heading.
Line 52, "to form" should read --forming--.

COLUMN 29

Line 45, "HNOC HNOC" should read --HNOC.HNOC--.

COLUMN 33

Line 60, "4hydroxybenzyl)" should read --4-hydroxybenzyl)--.
Line 61, "2,4,6tris" should read --2,4,6-tris--.

COLUMN 35

Line 59, "thyl2," should read --thyl-2,--.
Line 63, "4hydroxybenzyl)" should read --4-hydroxybenzyl)--.
Line 64, "2,4,6tris" should read --2,4,6-tris--.

COLUMN 36

Line 3, "4-1-butenyl)" should read --4-(1-butenyl)--.

UNITED STATES PATENT AND TRADEMARK OFFICE

CERTIFICATE OF CORRECTION

PATENT NO. : 5,008,168

DATED : April 16, 1991

INVENTOR(S) : MASARU NAKAGAWA, ET AL

It is certified that error appears in the above-indentified patent and that said Letters Patent is hereby corrected as shown below:

COLUMN 38

Line 25, "4hydroxybenzyl)" should read --4-hydroxybenzyl)--.
Line 26, "2,4,6tris" should read --2,4,6-tris--.

Signed and Sealed this

Twenty-fourth Day of May, 1994

*Attest:*

Bruce Lehman

BRUCE LEHMAN

*Attesting Officer*

*Commissioner of Patents and Trademarks*